US010085479B2

(12) United States Patent
Druzdzel et al.

(10) Patent No.: US 10,085,479 B2
(45) Date of Patent: Oct. 2, 2018

(54) APPARATUS, METHOD AND SYSTEM FOR BUFFERING AND PROCESSING MULTI-SEGMENT ROD-LIKE ARTICLES

(71) Applicant: AIGER GROUP AG, Zug (CH)

(72) Inventors: Arkadiusz Druzdzel, Radom (PL); Bogdan Nikolov, Plovdiv (BG); Plamen Iliev, Plovdiv (BG)

(73) Assignee: AIGER GROUP AG, Zug (CH)

( * ) Notice: Subject to any disclaimer, the term of this patent is extended or adjusted under 35 U.S.C. 154(b) by 733 days.

(21) Appl. No.: 14/200,711

(22) Filed: Mar. 7, 2014

(65) Prior Publication Data

US 2015/0251854 A1 Sep. 10, 2015

(51) Int. Cl.
*A24C 5/35* (2006.01)
*A24C 5/00* (2006.01)

(52) U.S. Cl.
CPC ..... *A24C 5/35* (2013.01); *A24C 5/00* (2013.01); *Y10T 83/2074* (2015.04)

(58) Field of Classification Search
CPC ..... A24C 5/35; A24C 5/00; Y10T 83/2074; A24D 3/0287; A24D 3/0225; A24D 3/0245
USPC ..... 493/45
See application file for complete search history.

(56) References Cited

U.S. PATENT DOCUMENTS 3,215,250 A * 11/1965 Schubert ..... A24C 5/336 198/377.04
3,957,152 A * 5/1976 Heitmann ..... A24C 5/322 198/462.1
3,961,633 A * 6/1976 Schubert ..... A24D 3/0287 131/94

(Continued)

FOREIGN PATENT DOCUMENTS

EP 2 210 509 A1 7/2010
WO 2006/000918 A2 1/2006
WO 2013/076750 A1 5/2013

OTHER PUBLICATIONS

International Search Reporting and Written Opinion dated Dec. 2, 2014 from corresponding International Patent Application No. PCT/US2014/021791; 9 pgs.

*Primary Examiner* — Sameh Tawfik
(74) *Attorney, Agent, or Firm* — Maier & Maier, PLLC

(57) ABSTRACT

An apparatus and method for buffering and processing loose rod-like articles including a feeder belt in communication with an inlet rotary portion, an intermediate rotary portion in communication with the inlet rotary portion and a discharge rotary portion, and a discharge belt in communication with the discharge rotary portion. The inlet rotary portion, intermediate rotary portion, discharge rotary portion define a transit path that serves buffering and/or processing purposes for a rod segment or rod segment group. Mechanical separators are distributed circumferentially about a periphery of each of the rotary portions, with processing compartments formed between respective mechanical separators to receive (Continued)

the rod segment or rod segment group. One or more supplementary processing zones are distributed adjacent a circumference of one or more rotary portions with an assembly proximate the supplementary processing zones. The assembly exerts a controlled process transversely through the transit path.

50 Claims, 23 Drawing Sheets

(56) References Cited

U.S. PATENT DOCUMENTS 4,287,979 A * 9/1981 Molins ..... A24D 3/0287 131/94
4,321,050 A * 3/1982 Oesterling ..... A24D 3/0254 493/343
5,024,242 A * 6/1991 Garthaffner ..... A24C 5/00 131/280
5,349,968 A * 9/1994 Rizzoli ..... A24C 5/471 131/282
5,551,544 A * 9/1996 Draghetti ..... A24C 5/35 198/404
7,481,757 B2 * 1/2009 Spiers ..... A24C 5/465 493/39
7,578,777 B2 * 8/2009 Draghetti ..... A24D 3/0287 131/280
8,360,947 B2 * 1/2013 Eusepi ..... A24D 3/0287 131/88
8,475,348 B2 * 7/2013 Yanchev ..... A24D 3/0287 493/39
2005/0054501 A1 * 3/2005 Schroder ..... A24C 5/3412 493/39
2005/0194014 A1 * 9/2005 Read, Jr. ..... A24C 5/601 131/284
2011/0011412 A1 * 1/2011 Yanchev ..... A24D 3/0254 131/285

* cited by examiner

APPARATUS, METHOD AND SYSTEM FOR BUFFERING AND PROCESSING MULTI-SEGMENT ROD-LIKE ARTICLES

BACKGROUND

From about the first quarter of the 20th century, the cigarette-making industry provided cigarettes with a rod-shaped filter attached to a tobacco rod. First, manually attached and then, from the early 1950's, mechanically attached filters became a standard component of a cigarette. The cigarette industry experimented with multi-component cigarettes and filters starting from the early 1960's. Relevant means for manufacturing such products have been revealed, e.g. in Molins invention U.S. Pat. No. 3,080,871, followed by U.S. Pat. Nos. 3,131,612, 3,267,820, 3,267,821, etc.

This and other methods and devices are discussed e.g. in Philip Morris EP1763306, highlighting various imperfections and shortcomings. This document reveals an apparatus and a method of maintaining alignment of segments in the stream of aligned segments by means of suction, or has a plurality of spaced apart separators for maintaining the alignment of segments in the stream of aligned segments, or both. Suction preventing relative movement of the segments is applied through the holes in filter segment transporting wheels, holding the segments in position as they are transferred to a continuous paper web for downstream processing. However, this arrangement allows loose segments in transit between the preceding transporting wheel and the following transporting wheel of the apparatus to remain floating in the air, jostling adjacent segments and/or the transporting means, as they become released from the suction of the preceding wheel but are not yet in the suction range of the following transporting wheel. Further, for at least some of the segment arrangements, some or all of the segments are inconsistently mechanically supported by the spacers on the circumference of the transporting wheels. Since the aligned segments are of different length, density, structure, etc., and additionally, they are manufactured within upstream production tolerances, imposing random discrepancies between them, they behave differently when in the transfer zone between the transporting wheels. Consequently, twofold transition of the loose segments between the transporting wheels in the apparatus results in random, jerky relative longitudinal movement of the segments, and displacement against one another. This results in minute, yet highly undesirable imperfections in segment alignment when discharged at the exit from the apparatus onto the continuous paper web, for downstream processing. The effect is particularly pronounced at real production speeds, where a few thousand segments are handled a minute. As compared to previous methods, the imperfections in longitudinal segment alignments were reduced but still do not allow for meeting todays quality standards of rejecting off-specification products and maintaining waste production losses. Moreover, due to the use of suction for maintaining alignment of segments during transportation towards downstream processing, this arrangement does not allow for handling fragile, low density and/or highly porous segments made of e.g. non-wrapped low-density cellulose acetate. Further, this arrangement does not allow for buffering and/or further advantageous processing of the segments to be carried out at the latest stage, and just before forming and sealing a continuous, endless rod of multi-segment rod-like articles as well known in the industry and to personnel skilled in the art.

Still further, EP2210509(A1) discloses a method of compacting, wrapping and cutting components of a rod-like articles wherein at least one of the components is a non-cleanly-cuttable component like a combustible heat source or fuel element, for example a carbonaceous heat source that remains in direct contact with the component transporting means, e.g. drums or wheels. In the disclosed method and apparatus, suction is used to hold the components, and known vacuum transfer techniques are used to transfer the components between drums. Since the revealed method requires suction or vacuum for transporting components, it is risky when transporting active powder-containing segments, e.g. heat sources, and also not suitable for transporting fragile, easily deformable, brittle components of the rod-like articles. The revealed method of compacting combustible heat source components or other chemically active compounds of the rod-like articles boosts the risk of inter-product and intra-product contamination affecting product quality, percentage of waste and overall productivity.

Also, newer methods and apparatuses described in, e.g. EP2633769, U.S. Pat. No. 8,475,348 or EP2628399, EP2653044, EP2636322, etc., disclose principles and methods of manufacturing multi-component filter rods by means of various arrangements of filter segment transfer mechanisms. Moreover, numerous patent applications within the tobacco industry reveal mechanisms and methods of forming and transferring rod-like articles, specifically filter and/or cigarette rods using a variety of drum or wheel arrangements, e.g.: GB447779, GB477908, GB662309, GB709810, GB770173, GB915203, GB1351619, GB1476931, GB1438838, WO2013076750, etc.

Until the end of the 20th century, simple, single-segment filters constituted the majority of filters produced in the tobacco industry. Over the last two decades however, more and more complex filter specifications have been developed, including multi-component, multi-segment filters, consisting of segments precisely positioned relative to the adjacent segments, with such arrangements being fitted in the final filter attached to a cigarette or to another product meant for altering physical and organoleptic properties of smoke or, generally, air mixtures passing through such articles. Hence, there is a need for developing a means of reliably manufacturing increasingly advanced and demanding multi-component filters that are frequently referred to as composite or combined filter rods.

Currently, filter specifications use a range of filter segments that include, cellulose acetate of specific density and physical structure, with such rod material being wrapped in filter paper wrapper known as plug wrap, or formed as a rod-like article without wrapping in the plug wrap (so called non-wrapped acetate), non-cellulose acetate fibrous materials, particulate materials of specific absorption and filtration properties, heat energy sources, fragrance, taste and/or other sensory attributes-modifying articles, foreign articles, e.g. liquid-containing capsules and solid objects including shaped tubular objects, bio-decomposition catalytic substances, etc. Examples of such articles are disclosed in EP0880904, U.S. Pat. Nos. 4,714,082, 5,819,751, 5,040,551, 8,528,567, WO2011042175, WO2012000646, WO2013068081, EP1972213, EP2462822, etc.

Thus, in order to administer such substances in any required combination, and align them into a continuous rod-like article in a precisely pre-determined and recurrent manner, not affecting quality of any of the finished filter components, and with highly repeatable overall quality of the final filter product, an apparatus and method of achieving these goals is described in the disclosed invention.

BRIEF DESCRIPTION OF THE INVENTION

In one exemplary embodiment, an apparatus and method for buffering and processing a plurality of rod-like articles used in the manufacture of cigarette filters and in the manufacture of multi-segment rod-like articles may be disclosed. For example, the apparatus and method may be used for treating and altering physical properties of multi-segment filters, and organoleptic properties of air mixtures passing through such articles. An example of such apparatus may be disclosed in U.S. Pat. No. 8,475,348.

In another exemplary embodiment, an apparatus and method of manufacturing multi-component rod-like filtration articles and also, rod-like articles for adjusting the alignment of rod-like articles desired for downstream processing may be disclosed. The present invention may further allow for providing additional substances in a series of actions, as well as changes applied to all, or selected components of the multi-component or final product, between entering and leaving the apparatus towards downstream processing. In general, such final products may be manufactured for the purpose of treating and/or altering properties of air mixtures and therefore, they may be referred to as, for example, rod-like articles instead of simply filters.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION OF THE INVENTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Throughout the current description of the invention, commonly accepted terms may be utilized. For example, "processing" may be understood as applying forces, media, substances or mixtures of thereof to rod-like articles during their transit through the apparatus to, for example, adjust their properties prior to forming a final rod-like product.

Intensity of rod-like article interaction with the processing may be proportional to the time the rod-like articles are exposed to the processing. In addition, "buffering" may be used as separating two inlet and exit areas or otherwise adjusting filter rod transit time through the apparatus, providing adjustable time and space required for processing.

Figure 1:
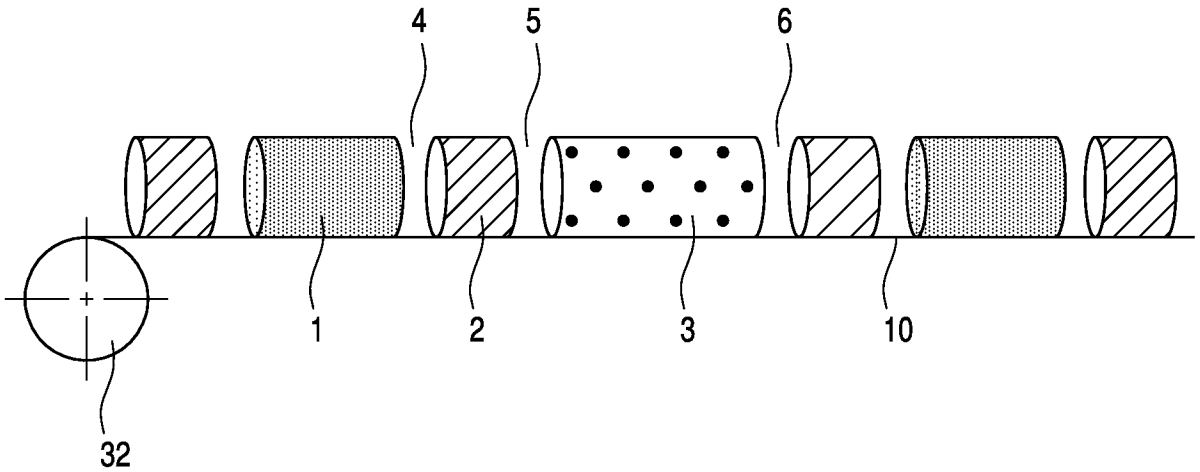
FIG. 1 is an exemplary embodiment of an initial alignment of rod-like article segments.

FIG. 1 may show an initial alignment of rod-like article segments (1, 2, 3) on a combining and feeding belt (10), prior to entering apparatus (A1). Every different segment or rod-like article (1, 2, 3) is positioned on the belt (10) by preceding, separate devices (not shown); the segments being separated with air gaps (4, 5, 6) kept consistently in-between the segments.

Figure 2A:
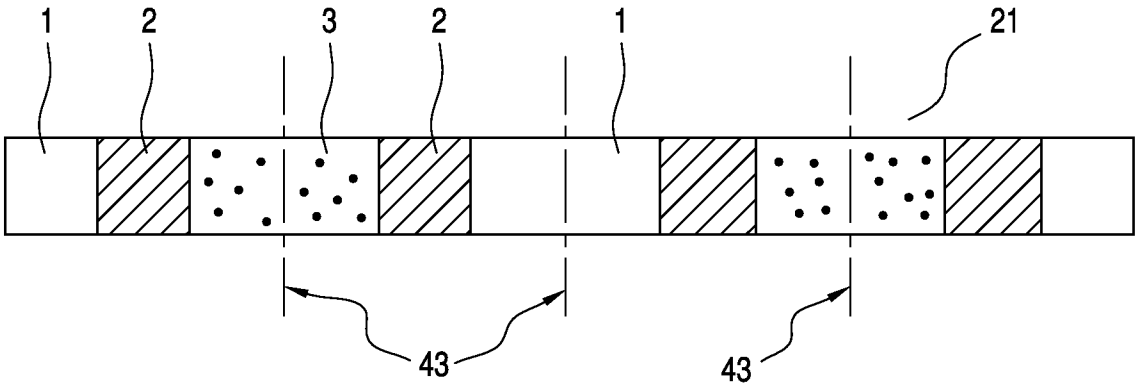
FIG. 2*a* is an exemplary embodiment of an arrangement of rod-like articles in a continuous composite article.

Referring generally to FIG. 2*a*, an arrangement of rod-like articles in a continuous composite article, showing continuous rod cutting positions (43) for obtaining triple, four-up articles in downstream processing (22) may be shown. The rod-like articles (1, 2, 3) may be aligned together in a pre-determined sequence, for specific filtration purposes or for altering physical and organoleptic properties and air mixtures. The example may show components of a typical combined filter having a first segment (1) made of e.g. cellulose acetate or an air gap (for making 'recess', semi-triple filters), a second segment (2) made of e.g. a mixture of cellulose acetate and loose particulate material, e.g. high-absorption charcoal powder, and a third segment (3) made of e.g. a mixture of cellulose acetate and fragrance releasing substances.

Figure 2B:
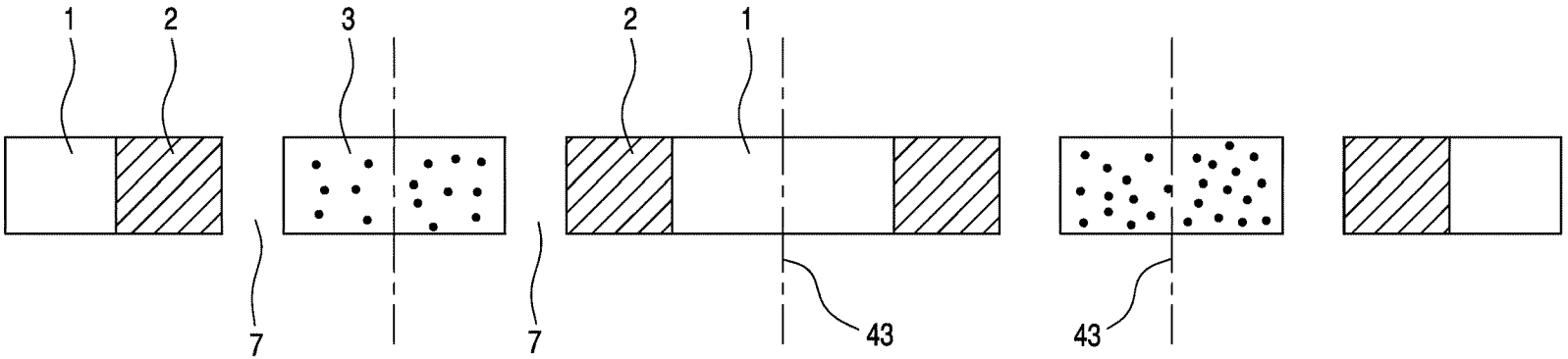
FIG. 2*b* is an exemplary embodiment of an arrangement of rod-like articles in a recess composite article.

Referring now to FIG. 2*b*, an arrangement of rod-like articles in a recess composite article upon exit from the apparatus, showing hollow sections, also known as 'cavities', made of air gaps (7) as well as the rod cutting positions (43) for obtaining four-up articles in downstream processing (not shown). The set-up shown in the FIG. 2*b* is another example of a multi-component filter arrangement that is based on the example shown in FIG. 2*a* with the difference being the air gap section (7) created on purpose between adjacent segments (2, 3) and having a precisely defined length. Such filters with the air gap section between other segments are commonly referred to as cavity filters.

Figure 3:
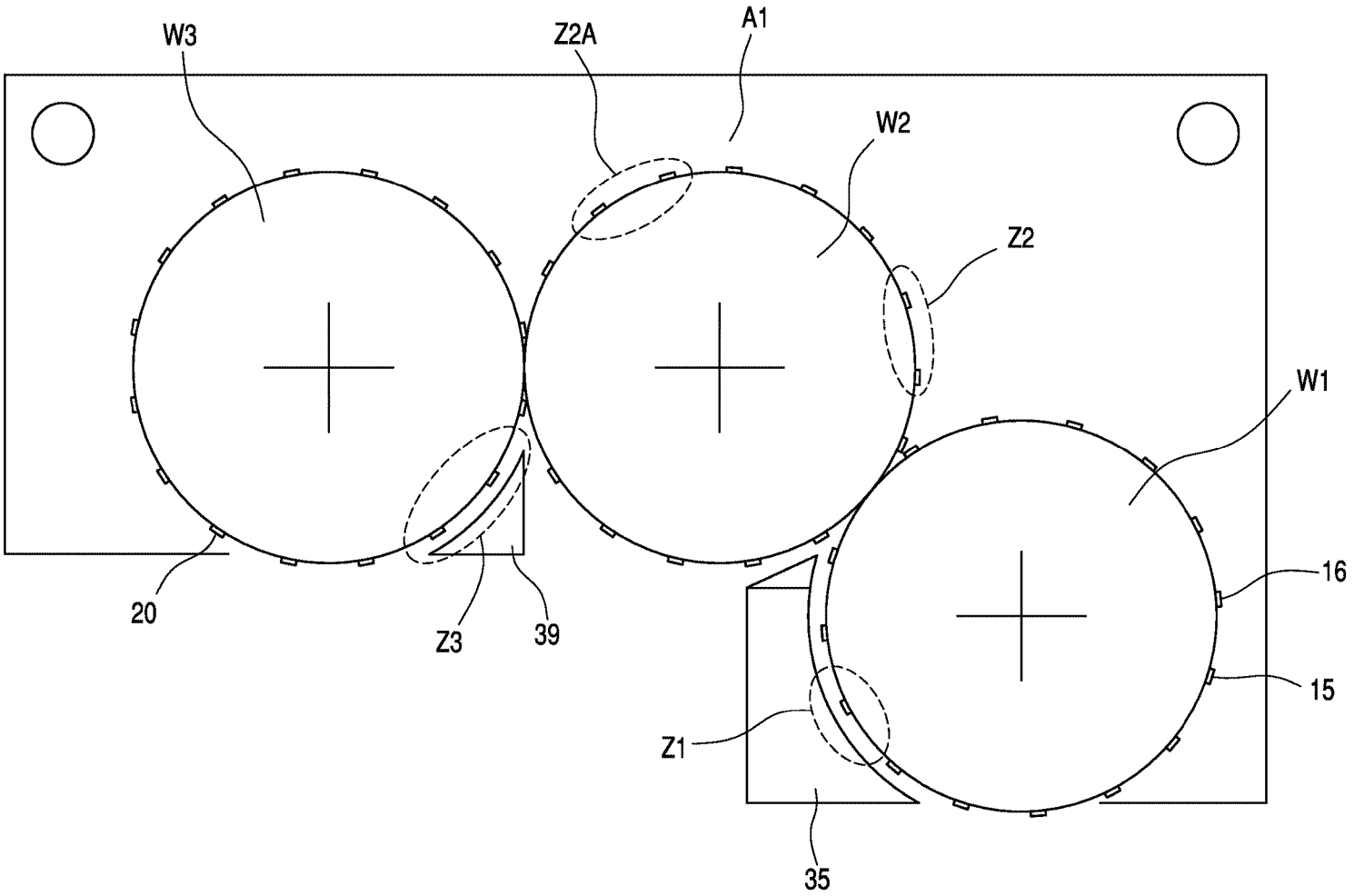
FIG. 3 is an exemplary embodiment of an arrangement of the rotary portions in an apparatus for buffering and processing rod-like articles.

FIG. 3 may show a first embodiment of the apparatus (A1) for buffering and processing rod-like articles. The apparatus may have inlet rotary portion (W1), intermediate rotary portion (W2), exit rotary portion (W3) and the frame of the apparatus (A1) allowing desired fixing of the rotary portions (W1, W2, W3). Moreover, FIG. 3 reveals exemplary locations of process zones (Z1, Z2, Z2A, Z3) in the apparatus (A1) allowing application of supplementary processing means, e.g. suction, gas vapors, electromagnetic radiation, etc., through the openings (12, 12'). In order to ensure efficient processing of specific combinations of rod-like articles (1, 2, 3), an angular length of the process zones is adjustable, and some or all of them may be joined, as shown in FIG. 7. Additionally, at least one of the process zones (Z1, Z2, Z2A, Z3) may be sealed against the other process zones so that various gas atmospheres (gases or vapors) and other means can be applied at a required pressure, e.g. underpressure or overpressure, specific to the treatment applied in the process zone.

Figure 4:
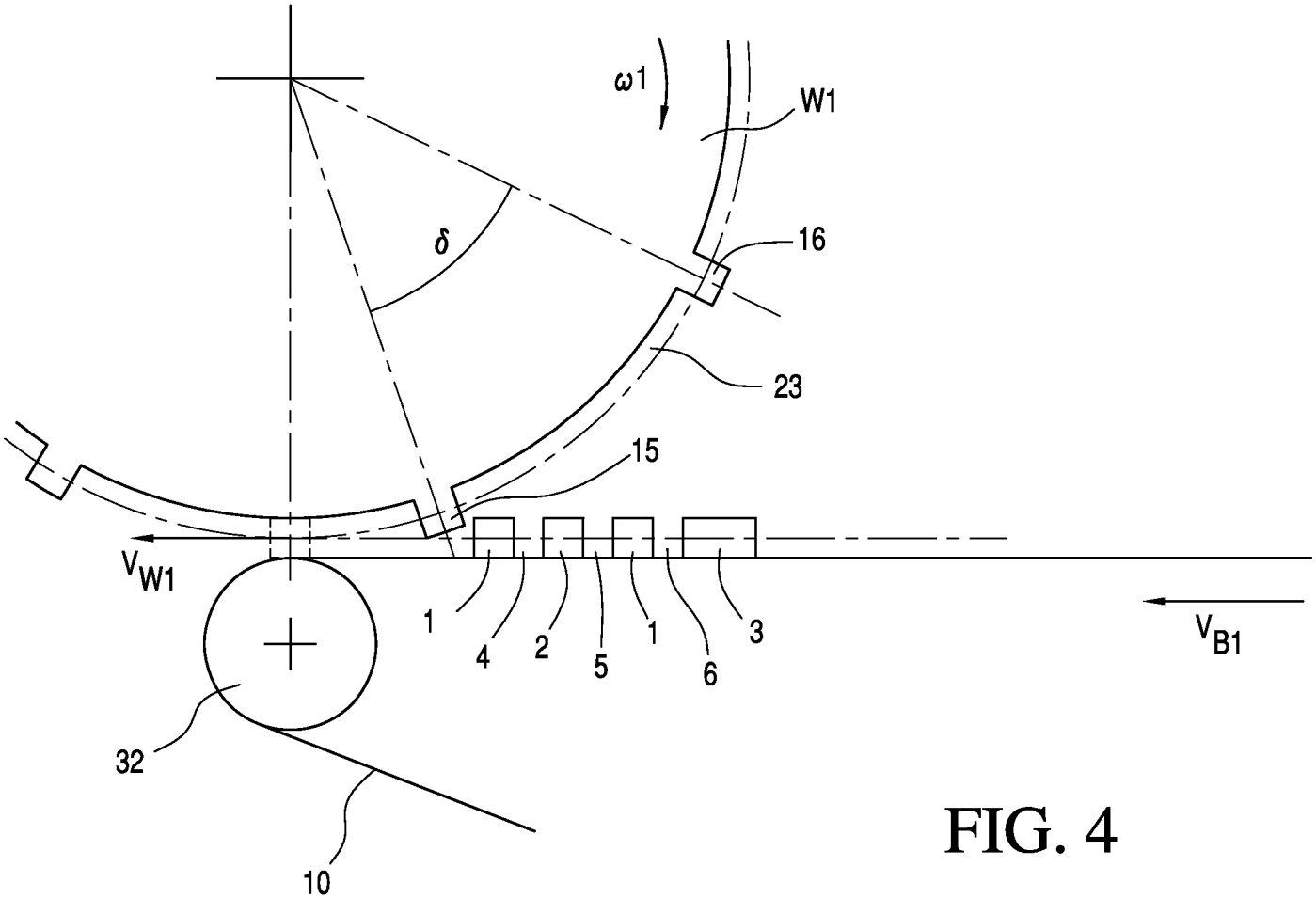
FIG. 4 is an exemplary embodiment of an arrangement of the rod-like articles inlet area to the apparatus.

According to the current invention, the apparatus in is part of the technology of making multi-component rod-like articles described in e.g. EP2633769, U.S. Pat. No. 8,475,348, etc. Once the rod-like articles are aligned in a required manner on the feeding belt (10), the alignment remains fixed until a final, multi-component rod is sealed and cut downstream the apparatus (A1). FIG. 4 shows an inlet to the apparatus (A1) and an initial exemplary arrangement of the rod-like articles in relation to the inlet rotary portion (W1) and the separators (15, 16). The feeding belt (10) is driven by the drive roller (32) and travels at linear speed ($V_{B1}$) while the inlet rotary portion (W1), driven independently from the feeding belt, revolves at angular speed (ω1) adjusted to maintain linear speed ($V_{W1}$) at the pitch diameter of the inlet rotary portion (W1). The two linear speeds may be adjusted such that the linear speed ($V_{B1}$) of the feeding belt (10) is higher than the linear speed ($V_{W1}$) at the pitch diameter of the inlet rotary portion (W1). Such setting may result in the back side of the separator (15) to work as a decelerator to the rod-like articles (1, 2, 3) being continuously fed to the apparatus (A1) and minimizing or removing the initial air gaps (4, 5, 6) from between the inlet rod-like articles (1, 2, 3). As the inlet rotary portion (W1) revolves over the angle (δ), between two subsequent separators, a required number of the rod-like articles may be collected in the processing compartment (23), between the separators (15, 16).

Figure 5:
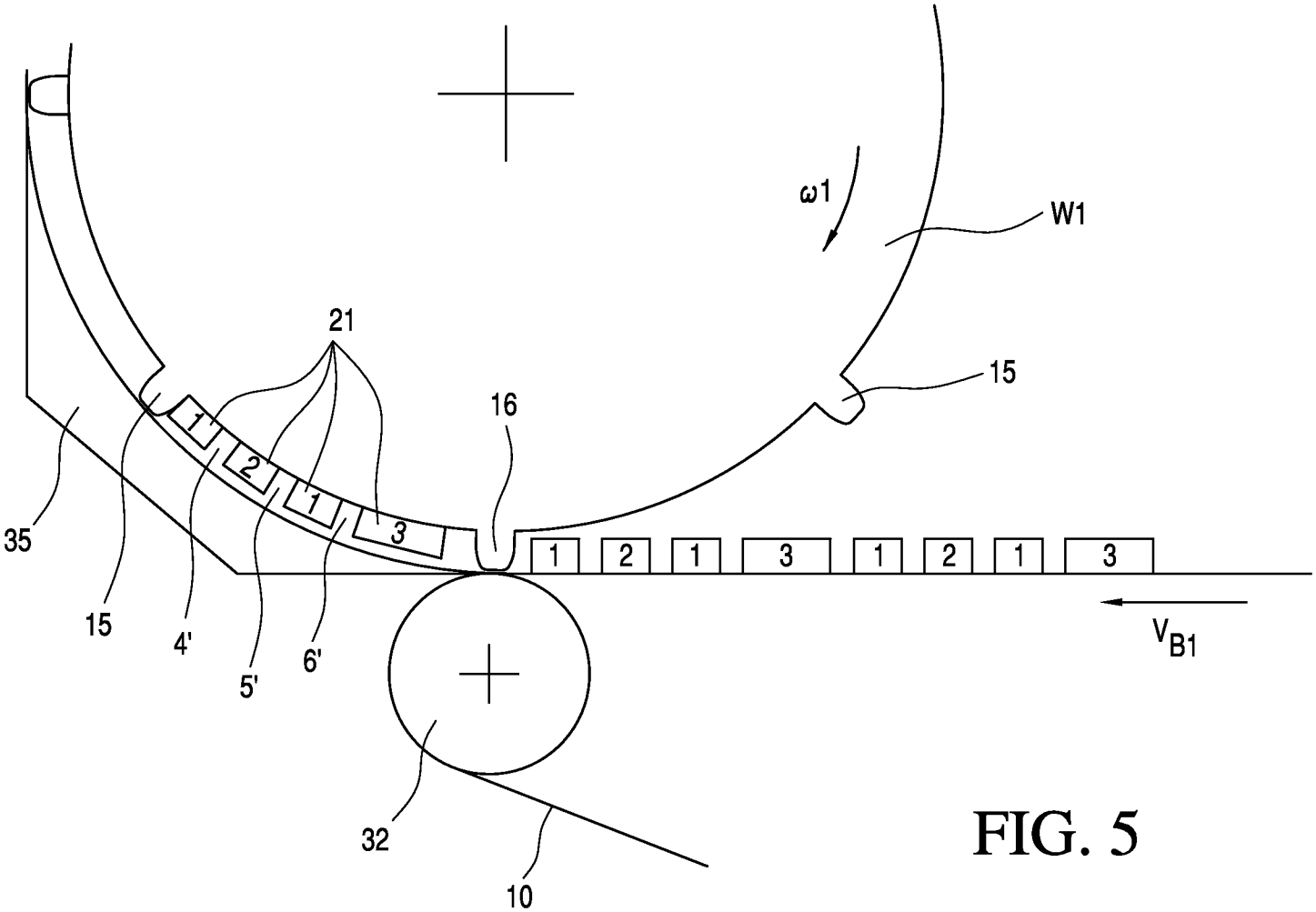
FIG. 5 is an exemplary embodiment of an arrangement of the rod-like articles inlet area to the apparatus.

FIG. 5 shows an exemplary subsequent phase of the process, when one of the processing compartments (23) is filled with rod-like articles (1, 2, 3) on the way to downstream processing. Since suction is not applied through the rotary portions (W1, W2, W3) to hold the rod-like articles (1, 2, 3) in place in the processing compartments (23) when in transit through the apparatus (A1), the rod-like articles may be subject to inertia forces due to angular movement of the rotary portion (W1) and friction forces between the rod-like articles (1, 2, 3), the driving rotary portion (W1) and the sliding guide (35). Additionally, since the rod-like articles (1, 2, 3) are manufactured to production tolerances, meaning that they randomly differ in length, weight, etc., between each other, this results in inconsistent forces acting on every rod-like article (1, 2, 3) and finally, in random spacing (4', 5', 6') between the rod-like segments (1, 2, 3) and the separators (15, 16).

Figure 6A:
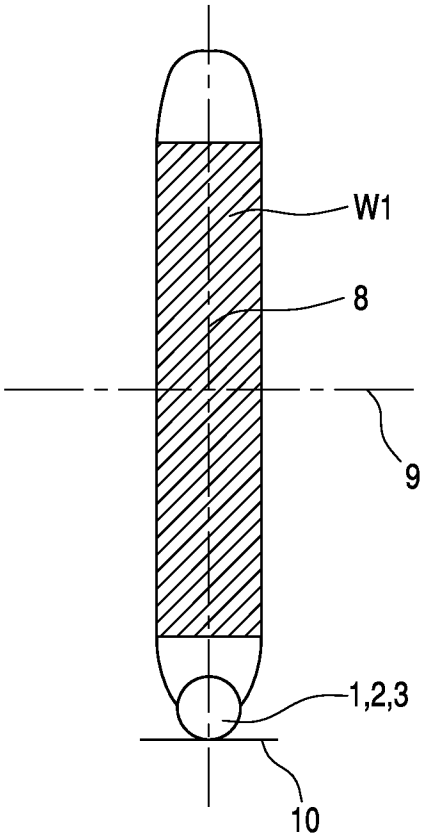
FIG. 6*a* is an exemplary embodiment of inlet rotary portion in vertical arrangement in relation to the belt feeding the rod-like articles.
Figure 6B:
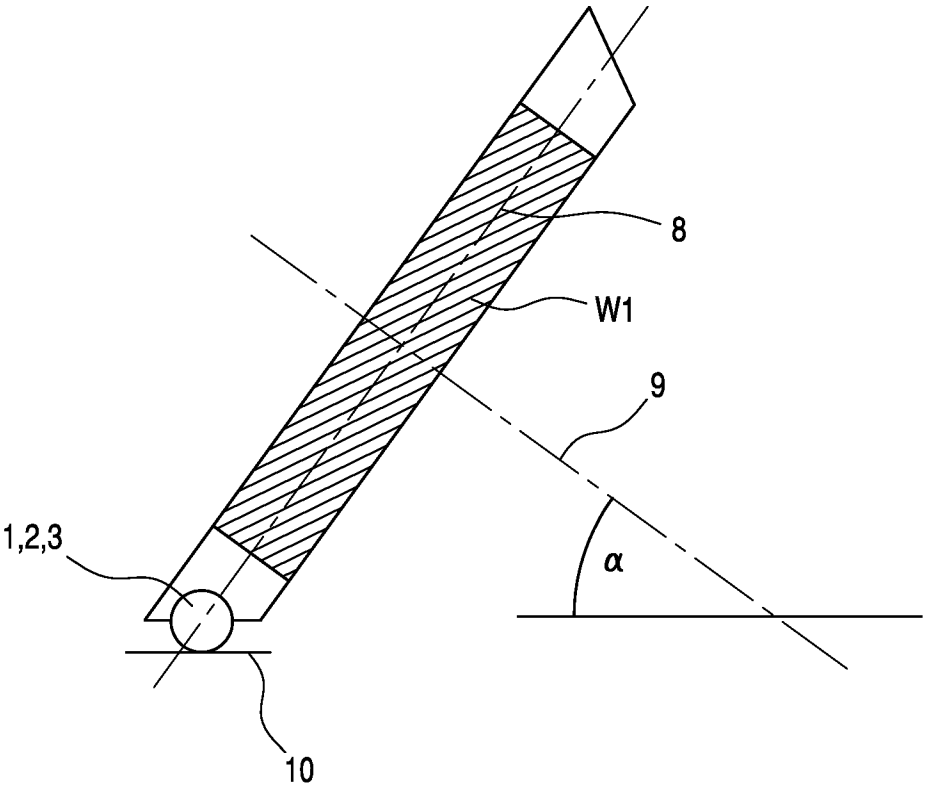
FIG. 6*b* is an exemplary embodiment of inlet rotary portion in angular arrangement in relation to the belt feeding the rod-like articles.
Figure 6C:
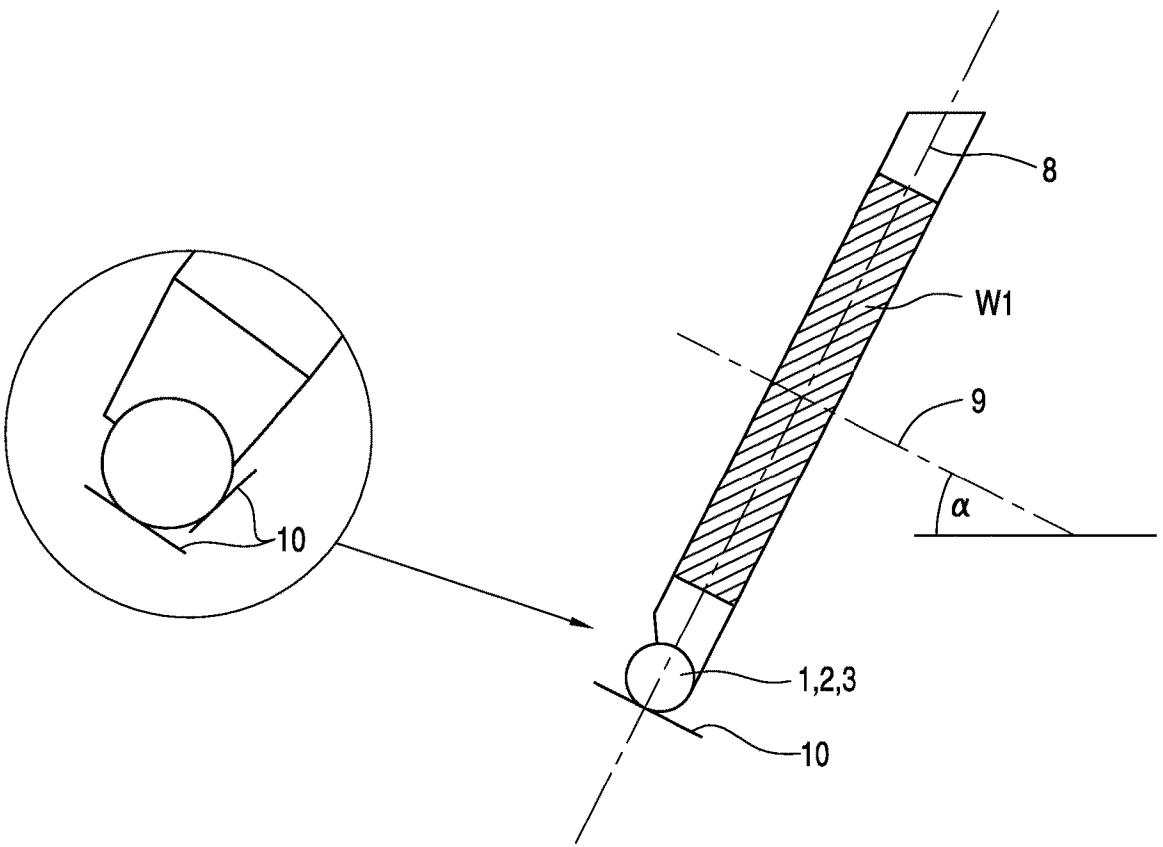
FIG. 6*c* is an exemplary embodiment of inlet rotary portion in angular arrangement in relation to an alternative arrangement of the belt(s) feeding the rod-like articles.

FIGS. 6*a-c* may show exemplary design varieties of the inlet rotary portion (W1). FIG. 6*a* shows the arrangement where its planar axis (8) remains vertical and the rotary portion revolves about its horizontal axis (9). FIGS. 6*b* and 6*c* show alternative arrangements of the inlet assembly to the apparatus. (A1) where the inlet rotary portion (W1) revolves about axis (9) at an angle (α), and the peripheral profile of the rotary portion (W1) is modified accordingly, as in the attached drawings. Modifications of the peripheral profile of the rotary portion (W1) may be implemented to minimize mutual mechanical interaction forces between the inlet rotary portion (W1) and individual rod-like articles (1, 2, 3), especially those of fragile structure, e.g. non-wrapped cellulose acetate segments, segments of irregular outer shape and/or porous materials containing embedded particulate substances. However, rotary portions (W1, W2, W3) of modified peripheral profile, especially profiled to obtain a bevel shape of one or all of the rotary portions (W1, W2, W3) may alternatively be used in at least one of the embodiments of the apparatus, described further, for example in FIG. 12.

Figure 7A:
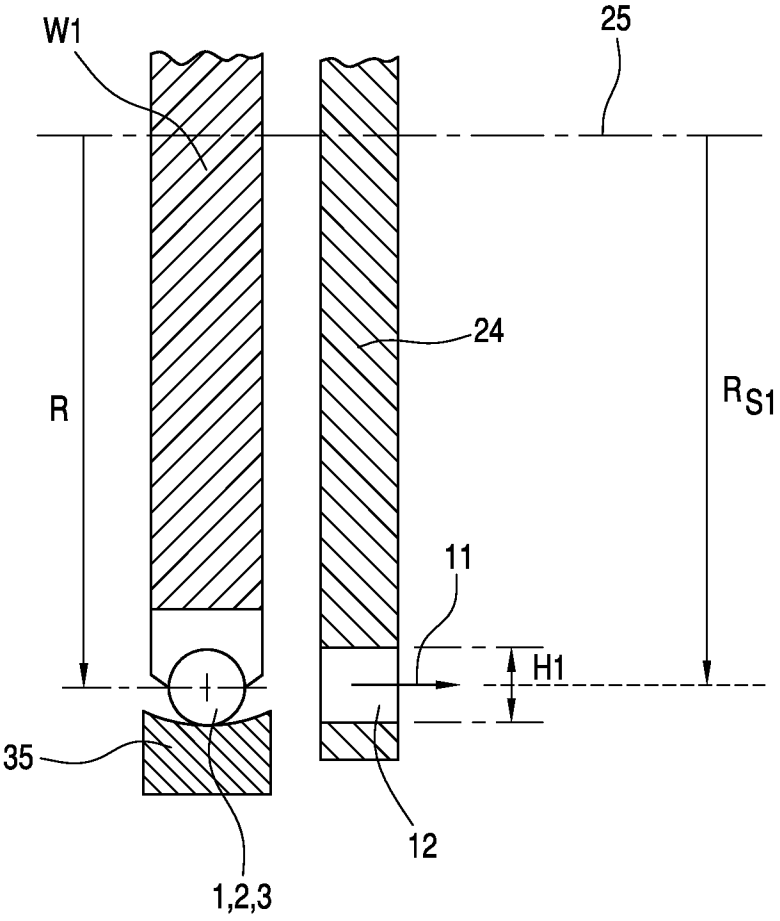
FIG. 7*a* is a cross sectional view of an exemplary application of at least one process, e.g. suction, applied at a radius, through an opening in the vicinity of the rod-like article.
Figure 7B:
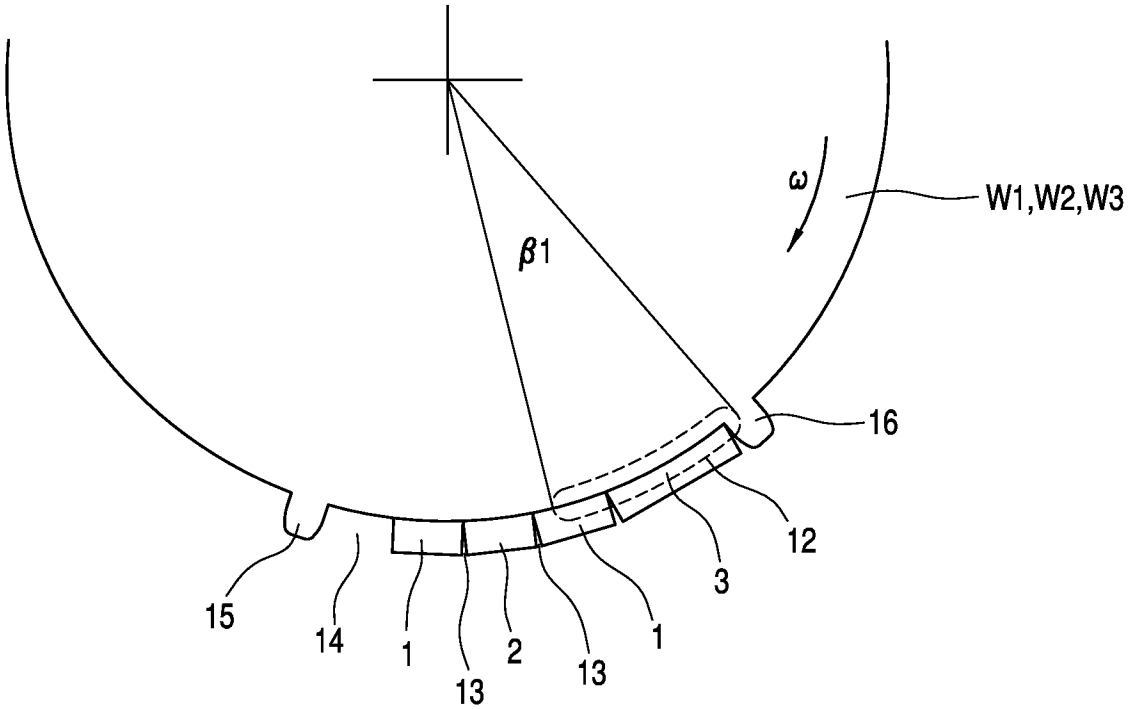
FIG. 7*b* is a front view of an exemplary application of at least one process, e.g. suction through an opening, in the vicinity of the rod-like article.
Figure 7C:
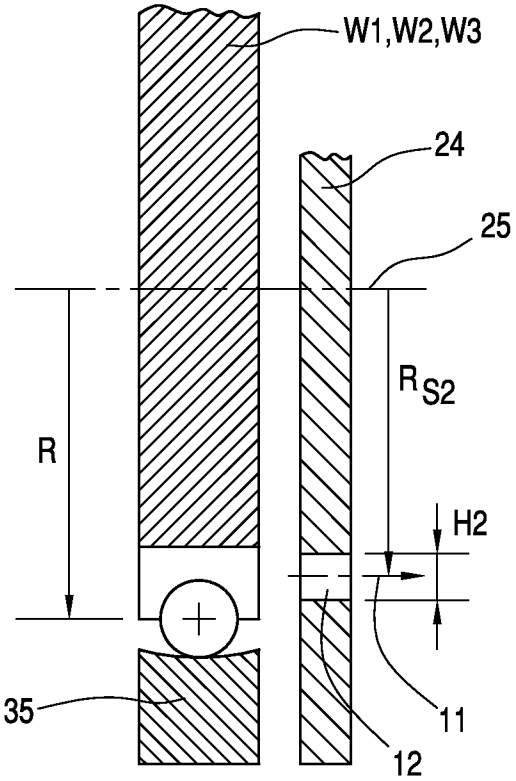
FIG. 7*c* is a cross sectional view of another exemplary application of at least one process, e.g. suction, applied at a radius, through an opening in the vicinity of the rod-like article.
Figure 7D:
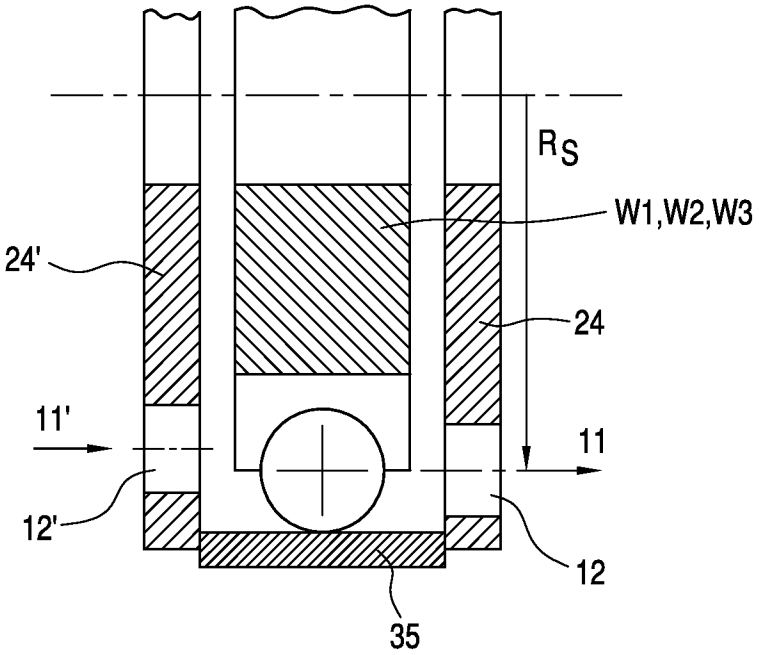
FIG. 7*d* is a cross sectional view of an exemplary application of supplementary processing means.

Before rod-like articles (1, 2, 3) are transferred for further processing from the inlet rotary portion (W1) to the second rotary portion (W2), they may pass by the first processing zone (Z1). FIG. 7*a* shows a schematic arrangement of the rod-like articles (1, 2, 3), the inlet rotary portion (W1) and the opening (12), constituting the processing zone. If required, the opening (12) may extend its angular length over an angle (β1), as shown for example in FIG. 7*b*. Through the opening (12, 12'), a supplementary processing means, e.g. suction, gas vapors, electromagnetic radiation, etc. can be administered transversely (11) to the transfer direction of the rod-like articles (1, 2, 3). Moreover, the openings (12, 12') may be of variable height ($H_1$, $H_2$) at radius ($R_{S1}$, $R_{S2}$) relative to the rotary portion (W1, W2, W3). In order to intensify processing effect, the angular shape of the openings (12, 12') may vary over their angular length, represented by the angle (β1). Depending on the actual combination of supplementary processing means required for processing rod-like articles (1, 2, 3), the assembly (24) that enables administration of the process may remain stationary in relation to the rotary portions (W1, W2, W3) or may rotate at an angular speed synchronised with the rotary portions (W1, W2, W3). Bearing in mind systematically increasing number of complex and technically challenging number of production specifications for the rod-like articles for treating air mixtures, the arrangement shown schematically in FIG. 7*a* can be modified, for example as shown in FIG. 7*d*, with additional assemblies (24'), arranged in proximity of another side of one, two or all rotary portions (W1, W2, W3). Such arrangement of the assemblies (24, 24') and the rotary portions (W1, W2, W3) between them, allows for even more advantageously intensive and precise administration of supplementary processing means, with one assembly (24') controlling supply (11') and the symmetrically positioned, mirror assembly (24) receiving or controlling removal (11) of the supplementary processing means from the process zones (Z1, . . . , Z3).

An example of a practical application of the revealed arrangement of the opening or openings (12, 12') and the rotary portions (W1, W2, W3) is application of controlled atmosphere through suction (11) being exerted through the opening (12), transversely to the transfer direction of the rod-like articles (1, 2, 3) and independently of the rotary portions (W1, W2, W3). As the suction force is adjusted for each rod-like article specification separately, it allows deceleration of the rod-like articles (1, 2, 3) in the processing compartment (23) of the rotary portions (W1, W2, W3). One advantageous result of such treatment is that all rod-like articles (1, 2, 3) in the processing compartment (23) may be pushed back to the most rear position available in the compartment (23), eliminating random spacing and ensuring direct contact (13) between the rod-like articles (1, 2, 3) and rear separator (16), and thus reliably and continually defining a relative position of the articles throughout subsequent processing. Since a relative position of the articles (1, 2, 3) may be adjusted against the rear, pushing separator (16), the separator may work as a mechanical timing element allowing to fix and control a position of the rod-like articles (1, 2, 3) in the processing compartment (23), throughout the apparatus (A1). Moreover, suction may be applied for other processing reasons, e.g. in order to remove residual dust and/or loose particles remaining adhered to the rod-like articles (1, 2, 3) after preceding processes, e.g. cutting base rods (not shown) into defined length of the rod-like articles (1, 2, 3) and/or mechanical interaction on the way to and inside the apparatus (1). Another reason for applying suction may be to apply controlled atmosphere to the rod-like articles (1, 2, 3) in the processing compartment (23), e.g. such atmosphere containing menthol vapors and/or other fragrant or sanitizing vapors, and to maintain and/or control vapors saturation in the compartment (23) through removal of excess vapors and/or through cooling articles in the compartment (23).

Another exemplary practical application of the disclosed arrangement is application of a process exerted through opening or openings (12, 12') transversely to the transfer direction of the rod-like articles (1, 2, 3) and independently of the rotary portions (W1, W2, W3) to enforce controlled angular movement of the rod-like articles (1, 2, 3) when passing through at least one of the processing zones (e.g. Z1, Z2, Z2A, Z3). Such movement may allow, for example, a light beam to penetrate uniformly the rod material and induce required reactions, e.g. chemical reactions in the rod. Such laser beam may also make unique perforation patterns on each rod-like article independently so that unique perforation patterns can be applied to, and about, rod-like articles (1, 2, 3), a group of rod-like articles, or to a required batch of rod-like articles immediately before fixing their mutual position and sealing the final rod in downstream processing, for example in a garniture assembly. Such perforation patterns can be applied, for example, to modify a pressure drop of the air mixture passing through the filter and, such perforation patterns can further be used for authentication marking of rod-like articles (1, 2, 3), a group of rod-like articles, or to a required batch of rod-like articles.

In still another exemplary practical application of the disclosed arrangement is application of a process through opening or openings (12, 12') transversely to the transfer direction of the rod-like articles (1, 2, 3) and independently of the rotary portions (W1, W2, W3) to apply, for example, a sanitizing or fragrance-rich atmosphere through the processing zones (Z1, Z2, Z2A, Z3). For example, flushing the rod-like articles (1, 2, 3) passing through at least one of the processing zones (Z1, Z2, Z2A, Z3) with such atmosphere, or a very accurate application of a required fluid to only selected rod-like articles (1, 2, 3) through a single or a system of, for example, pulse jet nozzles distributed along the processing zones (Z1, Z2, Z2A, Z3). Such a processing mode may further require applying energy, for example, in the form of electromagnetic radiation that may control reaction kinetics aimed at obtaining a desired end effect. Such application or removal of energy may be aimed at, for example, controlling evaporation (drying), liquid solidifying or polymerization processes of earlier applied substances such as, for example, fragrance or taste enhancing liquids.

Figure 8A:
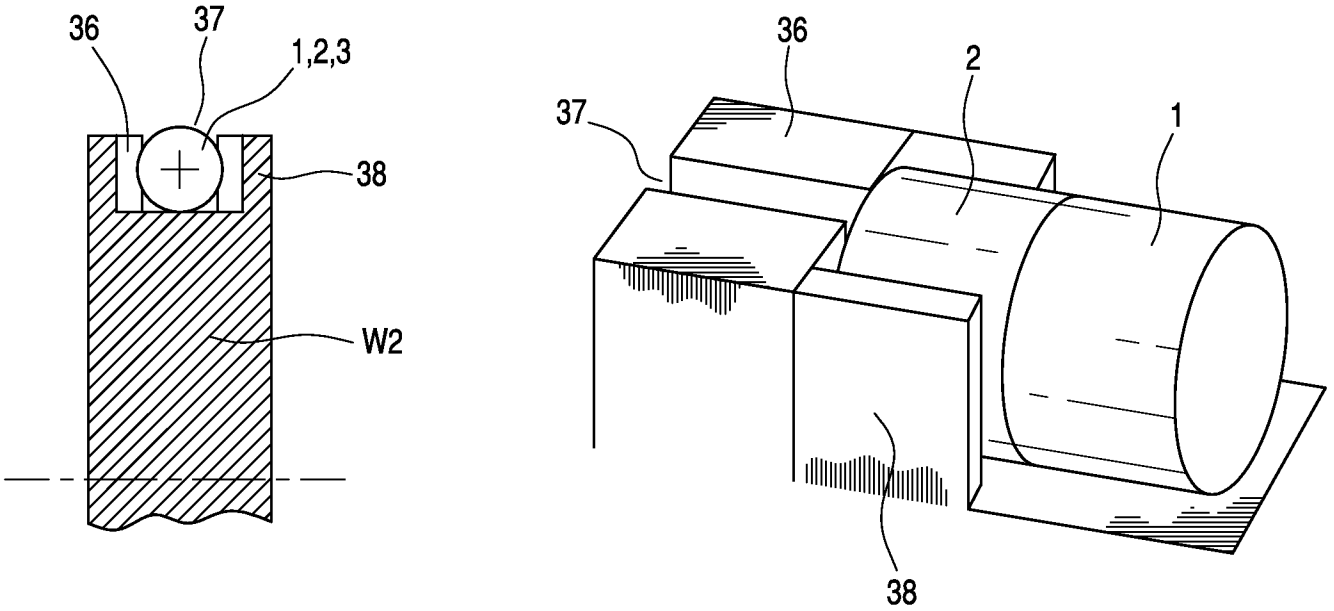
FIG. 8*a* is an exemplary embodiment of rotary portions with side guards protecting selected rod segments against applied supplementary processing means.
Figure 8B:
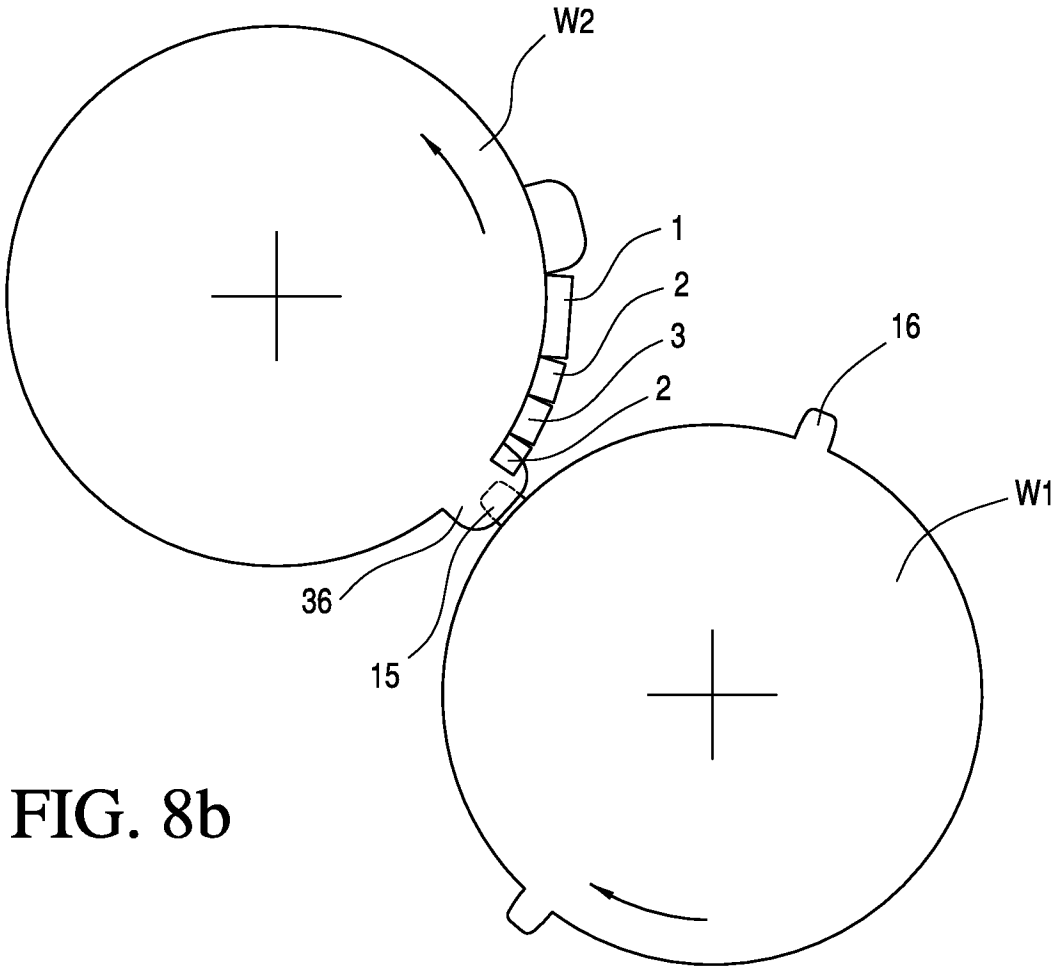
FIG. 8*b* is another exemplary embodiment of rotary portions with adjustable side guards protecting selected rod segments against applied supplementary processing means.
Figure 8C:
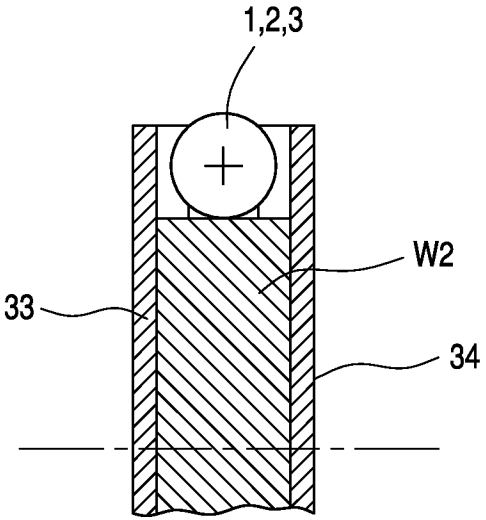
FIG. 8*c* is another exemplary embodiment of an arrangement of side guards on rotary portion, protecting selected rod segments against applied supplementary processing means.

Rod-like articles (1, 2, 3) may then be transferred to the subsequent rotary portions (W2, W3). In order to maintain an already fixed alignment of the articles (1, 2, 3) and the position of the articles (1, 2, 3), a continuous and consistent mechanical support may be ensured by direct contact of the rod-like articles (1, 2, 3) with the separators (20) throughout the complete transit towards downstream processing. Typical arrangements of the rotary portions (W1, W3) or typically, inner rotary portion (W2) only, is revealed for example in FIG. 8, where FIG. 8*a* shows an exemplary cross-section through the inner rotary portion (W2), with the peripheral separators (36) having a transverse air gap (37) along the circumference of the rotary portion, the air gap being wide enough to allow separators (15, 16) of the preceding and following rotary portions to get smoothly in-between the divided portions of the separator (36) and provide continuous and consistent support to the rod-like articles (1, 2, 3) in the transition zone, between rotary portion (W2, W3). FIG. 8*b* shows an exemplary side view of rod-like articles transition between rotary portions (W1, W2), showing schematically interaction between the separators (16, 36). Also, FIG. 8 reveals an innovative and advantageous design of the separators (36) with side shields (38) extending from the separators so that at least one, e.g. rear rod-like article (2) in the sequence of pre-aligned articles (1, 2, 3) remains screened from one or both sides, and thus remains protected from all or some of the applied supplementary processing means, e.g. suction, gaseous atmospheres, electromagnetic radiation, etc. Use of such designed separators may allow for processing fragile rod-like articles made of, e.g. non-wrapped cellulose acetate and/or articles containing fragrance, loose particles, etc. FIG. 8*c* shows an alternative exemplary arrangement of the rotary portion (W2) with portions (33, 34) that can be precisely, individually adjusted relative to the rotary portion (W2), and also quickly removed without readjusting the rotary portion (W2) or the whole apparatus (A1).

Figure 9:
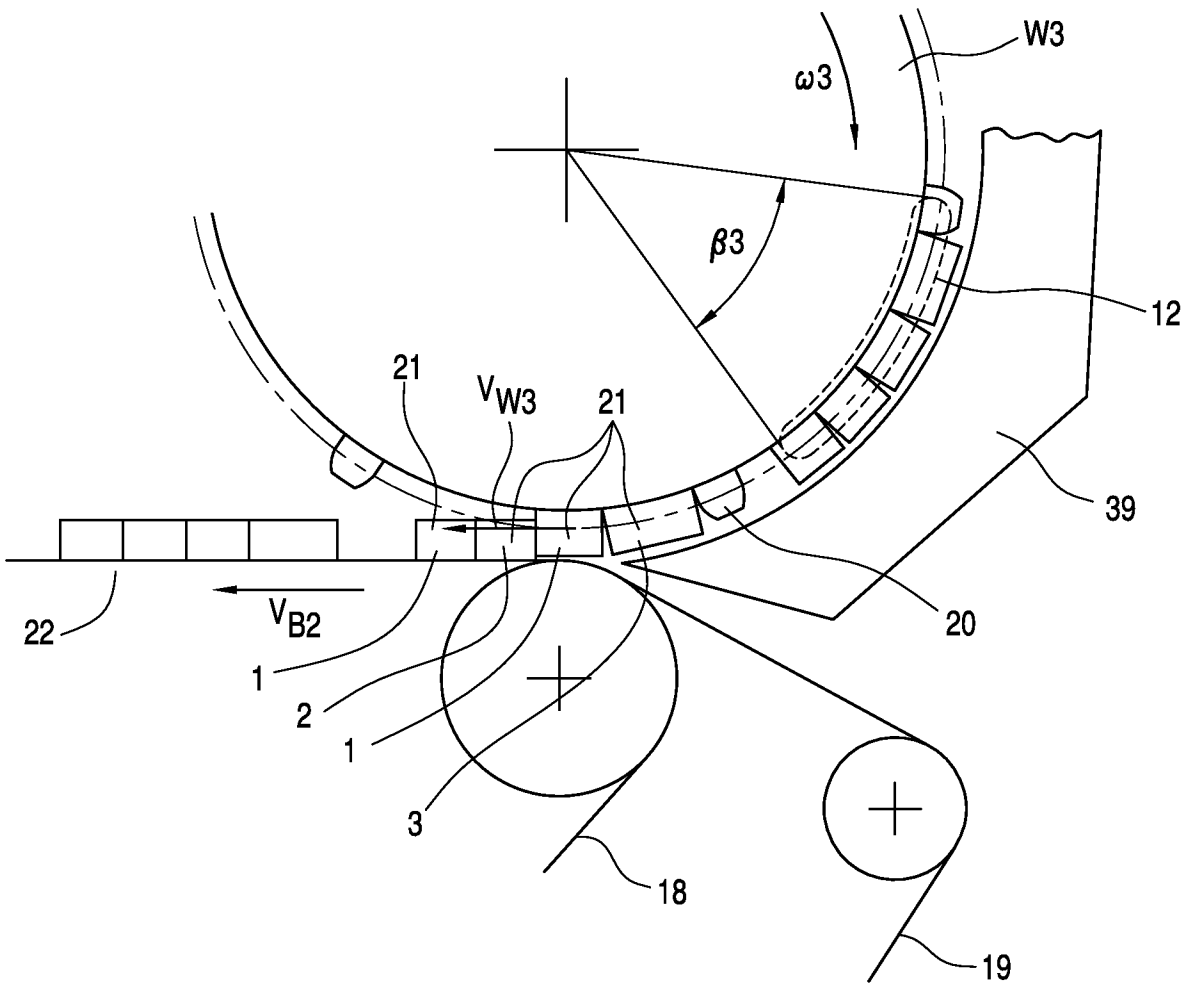
FIG. 9 is an exemplary embodiment of the apparatus exit arrangement of rod-like articles towards downstream processing.

Exit of the fully processed rod-like articles, in a prescribed alignment (1, 2, 3), to downstream processing (22) is shown in FIG. 9. In the exit area, friction forces between exit sliding guide (39), rod-like articles (1, 2, 3), and the rotary portion (W3), assisted by inertia forces due to rotary movement of the rotary portion (W3), constantly decelerate the articles (1, 2, 3) keeping them supported by the separator (20) that works as a mechanical timing element. In order to support friction and inertia forces in the exit area and ensure required processing result, application of supplementary processing means, e.g. suction, gas vapors, electromagnetic radiation, etc., in a manner discussed earlier in the document, is allowed through the opening (12) extending at the angle (β3). Such processed and aligned segments may then be discharged from the apparatus (A1) onto the continuous running paper web (19) driven by the endless belt conveyor (18) that form an initial part of downstream processing (22) where the paper web (19) is folded around the rod-like articles (1, 2, 3) by a folding and sealing assembly, known as a garniture assembly (not shown), producing a continuous, multi-component rod that is subsequently cut at predefined intervals when passing through a continuous rod cutting mechanism (not shown) producing discrete articles for treating and altering physical properties of air mixtures passing through such articles. A garniture assembly, continuous rod cutting mechanism, or any individually applied rod comminution mechanisms, as well as other details of downstream processing are not shown or further described here as they are well known in the industry and to persons skilled in the art.

The exit rotary portion (W3), rotates at angular speed (ω3) adjusted to maintain linear speed ($V_{W3}$) at the pitch diameter of the exit rotary portion (W3), the linear speed ($V_{W3}$), advantageously overlapping longitudinal axis of the rod-like articles (1, 2, 3) and being synchronized with the linear speed ($V_{B2}$) of the paper web (19). Most typical adjustments of linear speeds in the discharge zone sets $V_{W3}=V_{B2}$ so that mutual alignment of the rod-like articles (1, 2, 3) pre-set at the exit from the apparatus (A1) remain preserved when put onto the continuous running paper web (19) and sealed in the garniture. In such case, when $V_{W3}=V_{B2}$ a length of the separator (20), at its pitch diameter, and at the peripheral of the exit rotary portion (W3) defines the air gap (7) between rod segment groups (21) in the adjacent processing compartments (23). Such filter, as shown in FIG. 2*b*, is frequently referred to as a multi-component recess filter rod or a combined recess filter rod. In another case, when $V_{W3}>V_{B2}$ the higher $V_{W3}$ allows for pushing the rod segment group (21) being discharged on the continuously running paper web (19), eliminating the air gap (7) and producing multi-component filter rods also known as combiner filter rods. Any deviation from the pre-defined setting options of the linear velocities, especially maintaining $V_{W3}<V_{B2}$ may result in disadvantageous irregularities in rod-like articles (1, 2, 3) alignment, mainly due to inertia and friction forces occurring between already unsupported rod-like articles (1, 2, 3) and the paper web (19) moving at a different (higher) speed. This results in random longitudinal displacement of the rod-like articles (1, 2, 3) and adequate deviation of mutual alignment of the rod-like articles (1, 2, 3) discharged from the apparatus (A1, A2, A3) and produces randomly occurring air gaps in-between the rod-like articles (1, 2, 3) put on the continuously running paper web (19). The resulting deviation of mutual alignment of the rod-like articles (1, 2, 3) yields uneven cutting of such composite rod-like article and finally, off-specification and waste product, i.e. production losses.

The linear speed ($V_{W3}$) and the pace of rotation (ω3) of the exit rotary portion (W3) may be precisely controlled through, for example, their servo motors (not shown) and synchronised with the linear speed ($V_{B2}$) of the paper web (19). Since both number and angular distribution of the separators (20) on the circumference of the rotary portion (W3) may be defined and remain constant for every production specification of the rod-like articles, the exit rotary portion (W3) operates as a rotary encoder precisely converting angular position of the peripheral separators (20) into a reliable control signal to the continuous rod cutting mechanism (not shown) for cutting the continuous rod into a precisely determined discrete articles for treating and altering physical properties of air mixtures.

Figure 10:
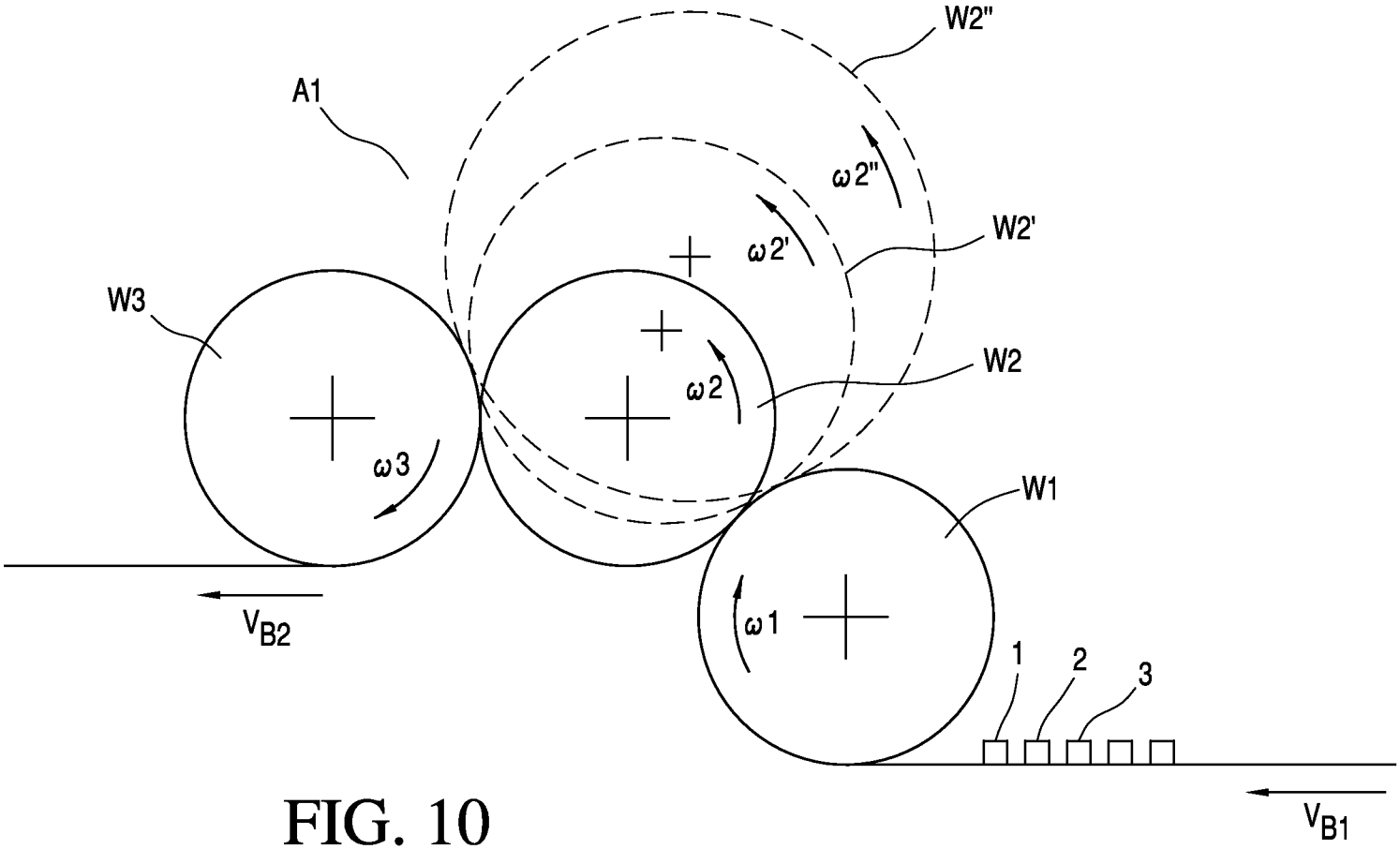
FIG. 10 is another exemplary embodiment of an arrangement of an intermediate rotary portion in the apparatus.

Further to the invention, FIG. 10 reveals an innovative, adjustable exemplary arrangement of the rotary portions (W1, W2, W3) with the inner rotary portion (W2, W2', W2") being of variable diameter, allowing the rod-like articles (1, 2, 3) travel time between adjacent portions (W1, W3) to be advantageously adjustable, according to requirements of supplementary processing by means of, e.g. suction, gas vapors, electromagnetic radiation, etc., applied in the apparatus (A1). This feature allows extending transit and processing time of the rod-like articles (1, 2, 3), proportionally to a selected diameter, and the circumference of the inner rotary portion (W2, W2', W2") and its angular velocity (ω) synchronised with adjacent portions (W1, W3). Depending on the particular filter rod specification being produced, different transit and/or processing times of the rod-like articles (1, 2, 3) may be required. In order to adjust transit and processing time of the rod-like articles (1, 2, 3), diameters of each of the rotary portions (W1, W2, W3) and therefore longer or shorter circumferences of the rotary portions (W1, W2, W3) as well as their respective angular speeds (ω1, ω2, ω3) can be chosen to be different within the apparatus. However, linear speed (V) at the circumference of each of the rotary portions (W1, W2, W3), where rod-like articles (1, 2, 3) are submitted to subsequent processing means, is maintained substantially the same throughout the apparatus, so that $V_{W1}=V_{W2}=V_{W3}$. In most cases, only intermediate rotary portion (W2) of another, smaller or bigger, diameter has to be selected, keeping inlet and exit rotary portions (W1, W3) the same and in the same place and thus minimizing brand change-specific adjustments. When required however, adjusting and fixing rotational shaft and axis of rotation of all the rotary portions (W1, W2, W3) is allowed in the apparatus. Mechanical assembly for adjusting and fixing rotational shaft and axis of rotation of the rotary portions (W1, W2, W3) are not shown as the solution is well known in the engineering literature. Consequently, application of supplementary processing means is allowed as final treatment, and adjustment of physical and/or organoleptic properties of all or only selected rod-like articles (1, 2, 3) immediately, i.e. typically, below one (1) second before the final product is formed and sealed in the garniture (not shown), during downstream processing (22).

Thus, as shown below in Example 1, changing a diameter of, for example, intermediate rotary portion (W2) may therefore allow for adjusting a length of segments travel path to suit processing needs of filter specifications. Example 1 assumes a first diameter of the intermediate rotary portion (W2) as D1=250 mm, and then changed to D2=350 mm, with production speed altered at exit from the apparatus in the range V=100-500 m/min. The following data table shows that a change in the diameter of the intermediate rotary portion (W2) only by 40% (from 250 mm to 350 mm), results in the transit time, used for segments curing or processing purposes increase proportionally, by Δ=40%, over the whole production speed range.

EXAMPLE 1

Diameter of W2 Vs. Transit Time

| Exit Speed | W1 = 250 mm | W2 = 350 mm | Δ= |
|---|---|---|---|
| 500 m/min | 0.047 s | 0.066 s | 41.6% |
| 400 m/min | 0.059 s | 0.082 s | 39.0% |
| 300 m/min | 0.079 s | 0.110 s | 39.2% |
| 200 m/min | 0.118 s | 0.165 s | 39.8% |
| 100 m/min | 0.236 s | 0.330 s | 39.8% |
| Average: | | | 40.0% |

Figure 11:
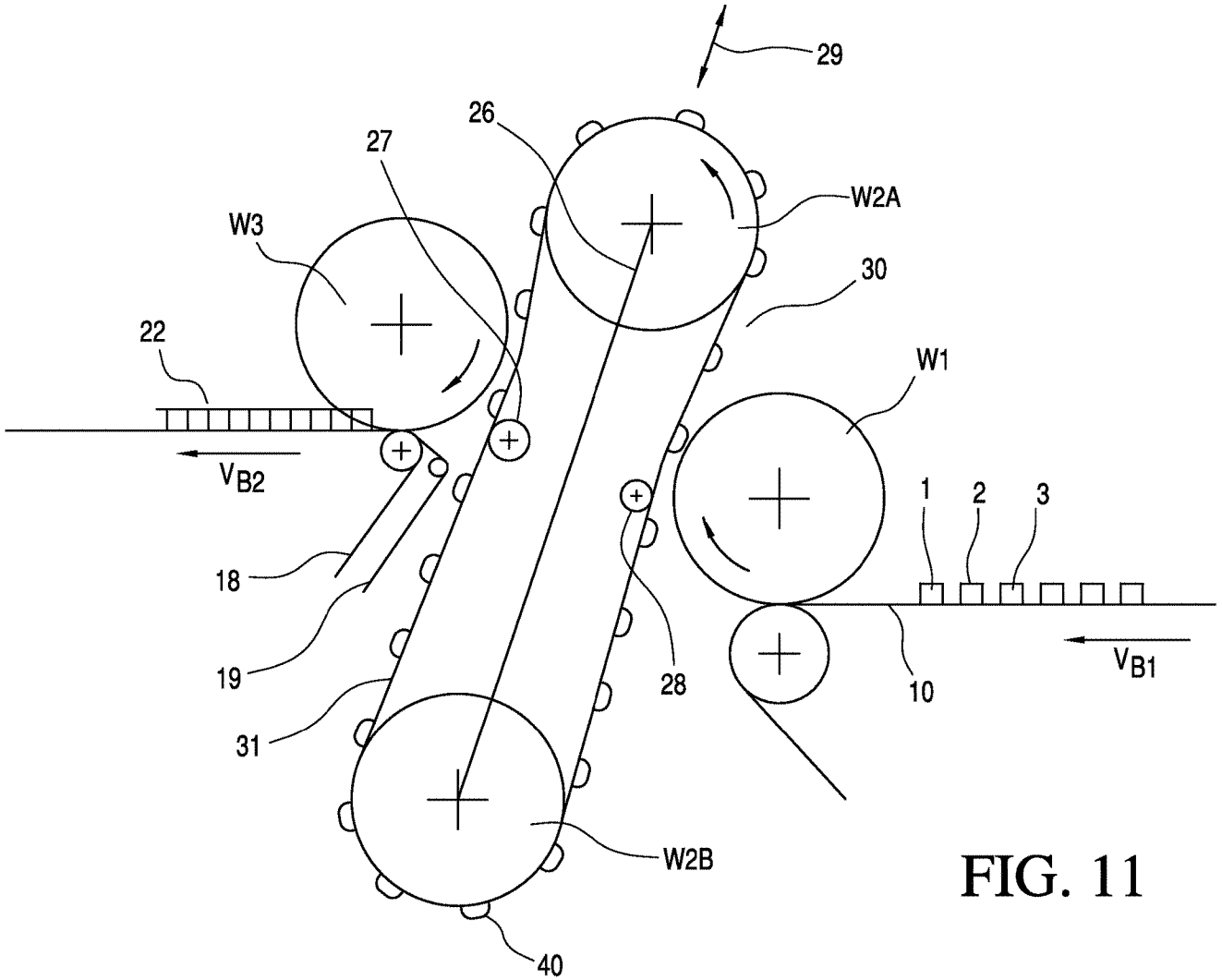
FIG. 11 is an exemplary schematic view of a variable capacity buffer.

FIG. 11 reveals an alternative exemplary arrangement of the inner section of the apparatus (A1) having a variable capacity buffer (30), movable (29) between its extreme upper and lower positions defined by the length of the movable frame (26) and thus being able to adjust a length of the transit path, and consequently the transit time of the rod-like articles (1, 2, 3) through the apparatus (A1). The part of the buffer (30) that conveys rod-like articles (1, 2, 3) between the preceding and following rotary portions (W1, W3) is later in the description referred to as the active part of the buffer (30) while the remaining part of the buffer, not conveying rod-like articles (1, 2, 3) is referred to as the passive part of the buffer (30). The buffer (30) may have a movable frame (26) including a first rotary portion (W2A) and a second rotary portion (W2B) mounted at two ends of the independently driven movable frame (26) and an endless belt (31) circumscribing the first rotary portion (W2A) and the second rotary portion (W2B) and moving between them. The active part of the buffer (30) is circumscribed by extendable sliding guides (not shown), working as sliding guides (35, 39), shown in the attached figures. The endless belt (31) may have a plurality of separators (40) distributed at the outer surface of the belt (31) and shaped for mating with preceding and following portions (W1, W3) as disclosed in FIG. 8. The belt (31) and the separators (40) can be made of plastic, rubber, metal, other suitable materials or a combination of such materials. Additionally, the belt (31) may be tensioned by a set of rollers (27, 28), movable inside the buffer (30) for maintaining adhesion of the rod like articles (1, 2, 3) and the mating parts (W1, W3, 31) as the capacity of the buffer (30) changes. The rollers (27, 28) may be the same size or may be different sizes. In order to improve reliability of transportation and/or enhance processing efficiency of the rod-like articles (1, 2, 3) passing through the buffer (30), supplementary processing means, e.g. suction, gas vapors, electromagnetic radiation, etc. can be applied throughout only a portion, or the whole extent of the active part of the buffer (30) in a manner that has already been disclosed above, in FIGS. 7 and 8. Additionally, the belt (31) and the first rotary portion (W2A) can be perforated along the contact area with the rod-like articles (1, 2, 3), which may facilitate application of all or only some of the supplementary processing means. The second rotary portion (W2B) can be similarly perforated along the contact area with the rod-like articles (1, 2, 3), for example, for belt cleaning purposes by means of suction or vacuum (not shown).

Variable capacity buffer (30) may therefore allow for adjusting a length of the travel path to suit processing needs of filter specifications, as shown in the following Example 2. The data table shows transit time through the variable capacity buffer (30) moving from an initial "0 mm" position to 500 mm height (i.e. moving up along direction 29), for two linear transfer speeds, V1=250 m/min and V2=500 m/min, resulting in an increase in the transit time through the buffer. The example shows transit time increase by approximately 255%, irrespective of the actual production speed.

EXAMPLE 2

Transit Time Vs. Buffer Height

| Height | V1 = 250 m/min | V2 = 500 m/min |
|---|---|---|
| 0 mm | 0.094 s | 0.047 s |
| 100 mm | 0.142 s | 0.071 s |
| 200 mm | 0.190 s | 0.095 s |
| 300 mm | 0.238 s | 0.119 s |
| 400 mm | 0.286 s | 0.143 s |
| 500 mm | 0.334 s | 0.167 s |
| Δ= | 255% | 255% |

The apparatus (A1), according to the exemplary embodiments disclosed in FIGS. 3-11 and described above, differs from the state of the art revealed in known literature as it solves the problem of handling fragile rod-like articles, including non-wrapped cellulose acetate filter segments and also, the problem of ensuring exact mutual alignment of any required combination of rod-like articles consistently, at exit from the apparatus (A1). Additionally, the present invention allows for adjusting transit time through the apparatus while not affecting inlet and exit settings, the adequately adjusted transit time being utilised for further, advantageous processing of the rod-like articles that may include applying supplementary processing means, e.g. suction, gas vapors, electromagnetic radiation, etc., immediately before forming and sealing the final product in the garniture.

FIG. 12 may show a second exemplary embodiment of the apparatus (A2) for buffering and processing multi-segment rod-like articles (1, 2, 3). Reference numerals in FIG. 12 are kept the same as previously used to identify similar parts of the apparatus (A2).

Figure 12A:
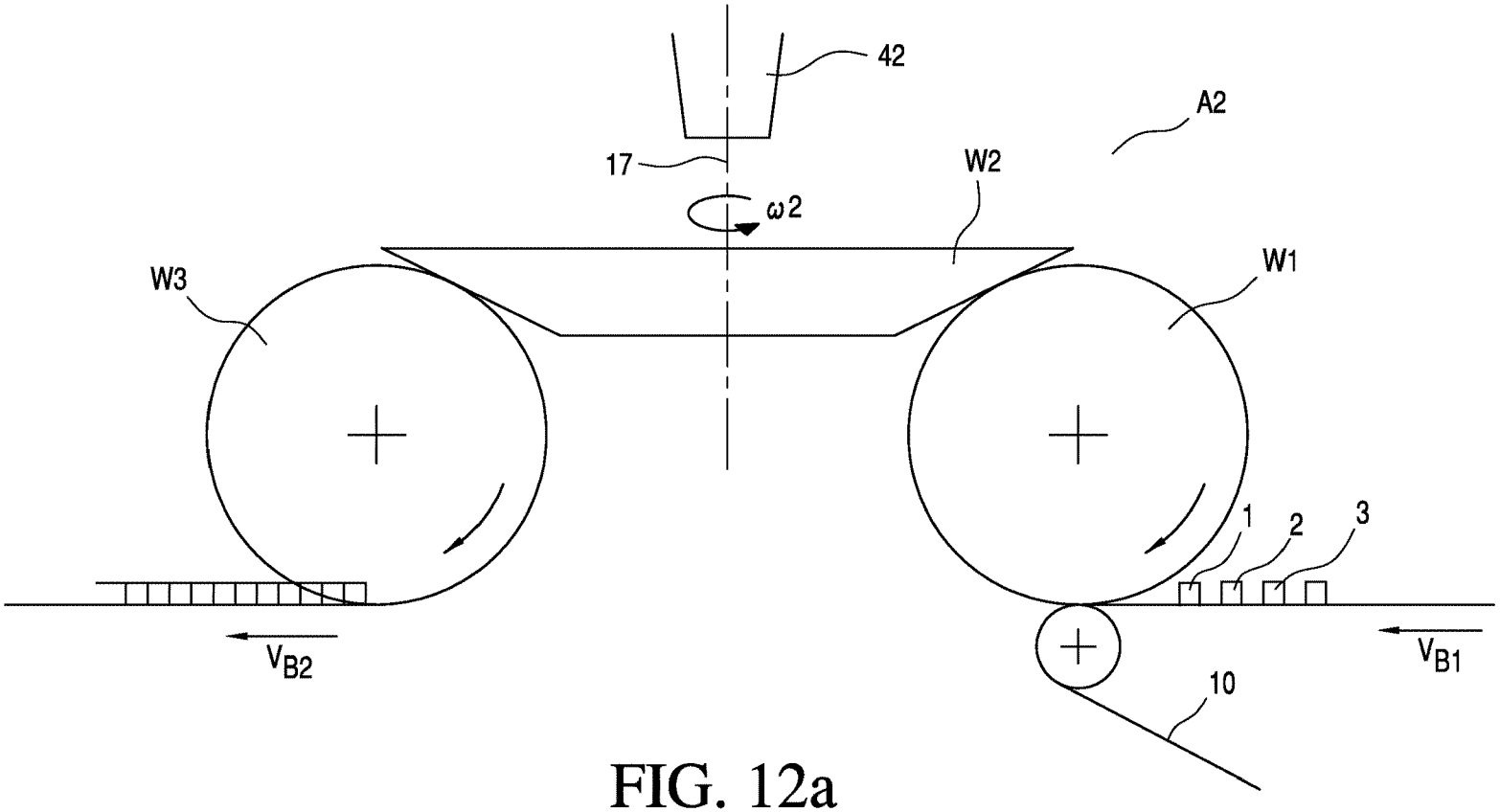
FIG. 12*a* is an exemplary side view of another exemplary embodiment of an apparatus showing rotary portions arranged for extended buffering, additional treatment and/or feeding supplementary articles into the stream of rod-like articles fed through the inlet rotary portion.
Figure 12B:
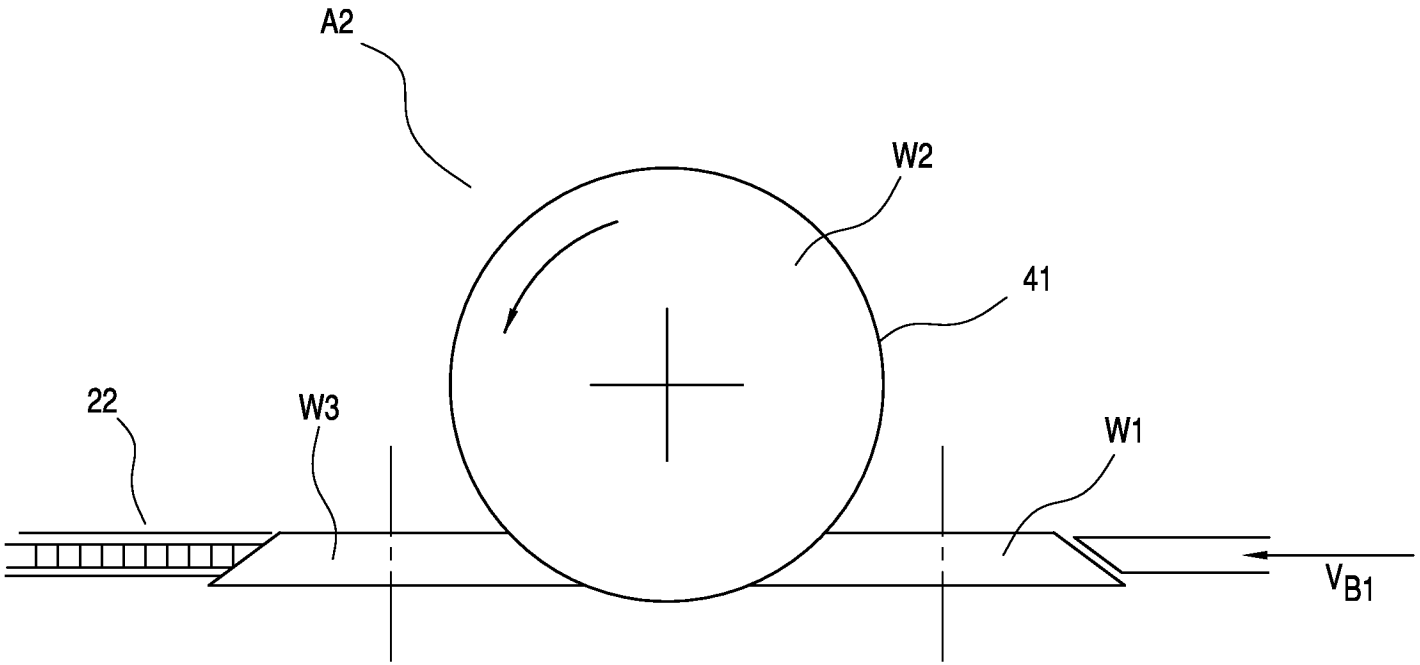
FIG. 12*b* is an exemplary top view of another exemplary embodiment of the apparatus showing rotary portions arranged for extended buffering, additional treatment and/or feeding supplementary articles into the stream of rod-like articles fed through the inlet rotary portion.

The apparatus (A2) may have inlet rotary portion (W1) and exit rotary portion (W3) arranged mostly vertically, as shown in FIG. 12*a*. However, inner rotary portion (W2) may be arranged to revolve about a mostly vertical axis of revolution (17). In order to ensure favorable collaboration of the mating rotary portions (W1, W2, W3), their peripheral shape is corrected as disclosed in FIG. 6 and described earlier, so that the rotary portions (W1, W2, W3) with bevel peripheral surfaces may be used in the apparatus (A2). Feeding and discharge sequence of the rod-like articles (1, 2, 3) to and from the apparatus (A2) is disclosed already in FIGS. 3 and 4, and the corresponding description of the process with minor modifications to shape of the sliding guides (35, 39) adjusted to follow the modified shape of the rotary portions (W1, W2, W3). FIG. 12*b* shows a top view of the apparatus (A2) as well as the transfer distance (41)

that may fully or only partially comprise the openings (12, 12') that constitute active processing zones (Z1, Z2, Z3) allowing application of supplementary processing means, e.g. suction, gas vapors, electromagnetic radiation, etc. in any required combination and intensity. The openings (12, 12') may extend maximally up to the full length of the travel path (41) along the circumference of the rotary portion (W2).

Figure 12C:
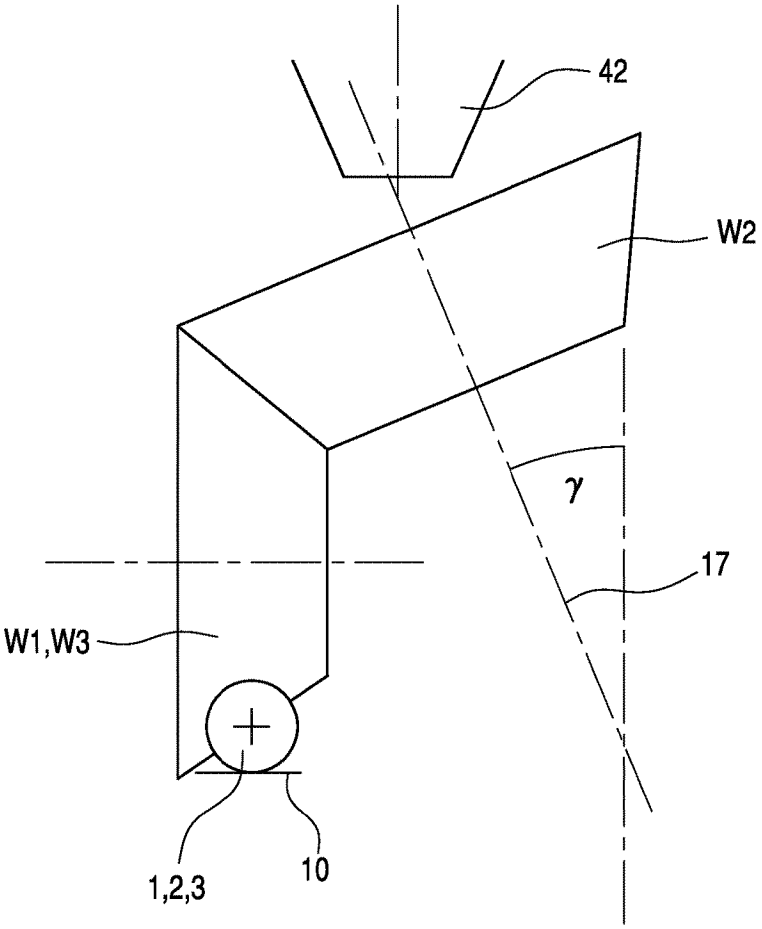
FIG. 12*c* is an exemplary side view of another exemplary arrangement of the apparatus showing rotary portions arranged at an angle facilitating extended buffering, additional treatment and/or feeding supplementary articles through a feeder into the stream of rod-like articles fed through the inlet rotary portion.

In one of the exemplary arrangements of the apparatus (A2), shown in FIG. 12*c*, the inner rotary portion (W2) is positioned at an angle (γ), with γ being in the range from 0 to 90 deg and preferably, in the range from 0 to 60 deg. Such an arrangement of the apparatus (A2) allows for advantageous transition of the rod-like articles (1, 2, 3) between the rotary portions (W1, W2, W3) and also advantageous application of selected supplementary processing means. The disclosed arrangement allows application of solid objects, e.g. gelatine capsules containing liquid and/or application of loose particulate material, e.g. charcoal and/or other particles required in manufacturing articles for treating air mixtures passing through. Application of the solid object, as described above, may be carried out through feeding means (42), independently of applying supplementary processing means, e.g. suction, gas vapors, electromagnetic radiation, etc.

Subsequently, the apparatus (A2) may allow for rearrangement and realignment of the rod-like articles from their initial (1, 2, 3) first in-first out (FIFO) alignment to their final (3, 2, 1) first in-last out (FILO) alignment at exit from the apparatus (A2). One of the preferred methods used for accomplishing precisely repeatable results of rearranging initial alignment of the rod-like articles (1, 2, 3), from FIFO to FILO alignment, is by adjusting a shape of the rotary portions (W1, W2, W3) and the separators (15, 16, 20), described in the first embodiment of the apparatus (A1), towards straight teeth as in bevel gears (with conical pitch surface and teeth being straight and tapering towards apex), or spiral helical teeth (curved at an angle allowing tooth-segment contact to be gradual and smooth thus, minimizing interfacial rubbing and degradation). Such shaped separators, or teeth, can be meshed in parallel or crossed orientations allowing full flexibility in orientation of the rotary portions (W1, W2, W3) and respective rotating shafts.

Figure 13:
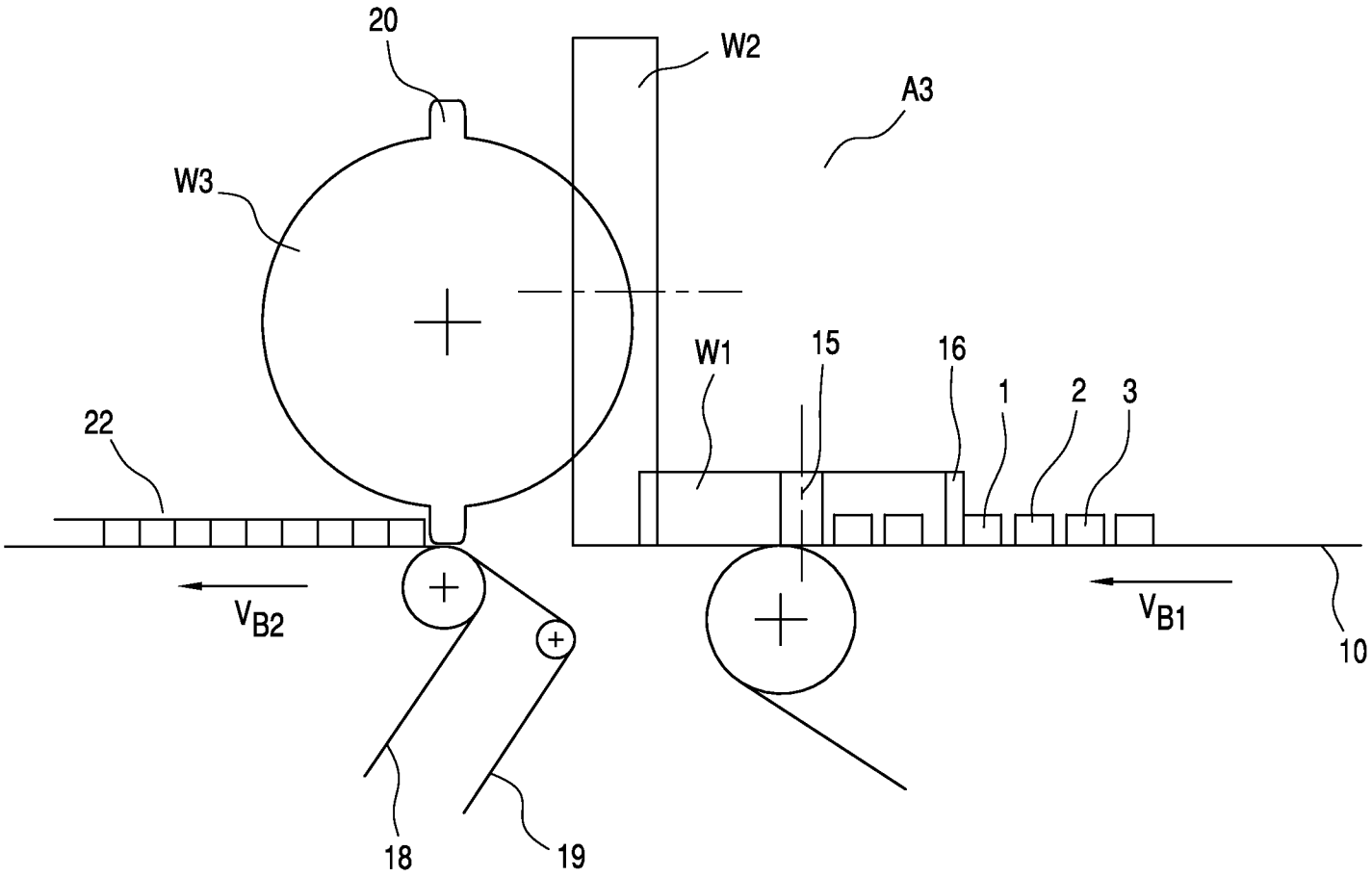
FIG. 13 is an exemplary side view of another exemplary embodiment of the apparatus showing rotary portions rotating about axes that are perpendicular to each other.

FIG. 13 may show a third exemplary embodiment of the apparatus (A3) for buffering and processing multi-segment rod-like articles (1, 2, 3). Reference numerals in FIG. 13 are kept the same as previously used to identify parts of the apparatus (A3).

The revealed third embodiment of the apparatus (A3) may have rotary portions (W1, W2, W3) used for buffering and processing multi-segment rod-like articles for treating air mixtures, which may have their axes of rotation perpendicular to each other, as revealed in FIG. 13. Revealed arrangement allows substantial extension of the buffering and processing time due to the fact that the inner rotary portion (W2) is adjusted transversely, e.g. perpendicularly, to the main flow direction of the rod-like articles being processed. This allows for fitting the rotary portion (W2) within the apparatus (A3) which allows using minimum space required for the apparatus (A3) in the production area. Other exemplary buffering and processing functions of the apparatus (A3) have already been disclosed above.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for buffering and processing loose rod-like articles comprising:

a feeder belt in communication with an inlet rotary portion;

at least one intermediate rotary portion in communication with the inlet rotary portion and a discharge rotary portion;

a discharge belt in communication with the discharge rotary portion, wherein the feeder belt, inlet rotary portion, at least one intermediate rotary portion, discharge rotary portion and discharge belt form a transit path to at least one rod segment or rod segment group, wherein a plurality of consecutive rod segments form a rod segment group;

a plurality of mechanical separators distributed at a pitch and spaced circumferentially about a periphery of each of the inlet rotary portion, the at least one intermediate rotary portion, and the discharge rotary portion;

a plurality of processing compartments formed between respective mechanical separators for receiving the at least one rod segment or rod segment group; and at least one supplementary processing zone distributed adjacent to a portion of a circumference of at least one of the inlet rotary portion, at least one intermediate rotary portion, and discharge rotary portion, the at least one supplementary processing zone being separate from the portion of the circumference and from the at least one of the inlet rotary portion, at least one intermediate rotary portion, and discharge rotary portion;

at least one assembly proximate the at least one supplementary processing zone, the at least one assembly exerting at least one process transversely through the supplementary processing zone and the transit path, the process is applied transversely to the rotation of the wheel; and at least one opening in the at least one assembly located proximate the transit path to exert at least one process transversely through the supplementary processing zone and the transit path, wherein the plurality of mechanical separators shape an angular position of each processing compartment on the circumferences of the inlet rotary portion, the at least one intermediate rotary portion, and the discharge rotary portion.

2. The apparatus of claim 1, wherein the plurality of mechanical separators are operable to accelerate or decelerate the at least one rod segment or rod segment group along at least a portion of the transit path.

3. The apparatus of claim 1, wherein the plurality of mechanical separators are operable to adjust a distance between individual rod segments in a rod segment group along at least a portion of the transit path.

4. The apparatus of claim 1, wherein the inlet rotary portion rotates at a first angular velocity such that the plurality of mechanical separators travel at a first linear velocity at a pitch diameter of the inlet rotary portion, wherein the first angular velocity is adjustable such that the first linear velocity is equal to or less than a linear velocity of the feeder belt.

5. The apparatus of claim 1, further comprising:

a perforation or slitting means along the transit path and proximate at least one processing compartment at any point during operation.

6. The apparatus of claim 1, wherein the plurality of mechanical separators act as a timing pusher to synchronize a discharge rate of at least one rod segment or rod segment group at a discharge point proximate the discharge rotary portion and the discharge belt.

7. The apparatus of claim 1, wherein an angular position of the plurality of mechanical separators of the discharge rotary portion is converted into a control signal for a rod cutting mechanism.

8. The apparatus of claim 1, wherein the at least one rod segment or rod segment group are subject to at least one of inertial and friction forces provided by at least one of the inlet rotary portion, the at least one intermediate rotary portion, and the discharge rotary portion while traveling through the transit path.

9. The apparatus of claim 1, wherein the at least one rod segment or rod segment group are mechanically sealed to the ambient environment when received within the plurality of processing compartments.

10. The apparatus of claim 1, wherein the plurality of mechanical separators have an involute geometry.

11. The apparatus of claim 1, wherein the plurality of mechanical separators are chamfered.

12. The apparatus of claim 1, wherein the at least one assembly remains stationary relative to a rotation of at least one of the inlet rotary portion, at least one intermediate rotary portion, or discharge rotary portion, and exerts the at least one process on the at least one rod segment or rod segment group when the processing compartment containing the at least one rod segment or rod segment group is proximate the supplementary processing zone.

13. The apparatus of claim 1, wherein the at least one process is one of a suction force, vacuum force, or introduction of a supplementary processing media transversely to the transfer direction of the rod-like articles.

14. The apparatus of claim 13, wherein the at least one process introduces a controlled atmosphere or media into a processing compartment decelerating the at least one rod segment or rod segment group when the processing compartment is proximate the supplementary processing zone.

15. The apparatus of claim 14, wherein the controlled atmosphere is a sanitizing atmosphere.

16. The apparatus of claim 1, wherein the at least one process is exerted on at least one rod segment or rod segment group in the vicinity of the supplementary processing zone, wherein the process is operable to decelerate the at least one rod segment or rod segment group, remove or minimize a distance between the at least one rod segment or rod segment group and a trailing mechanical separator, or add a distance between the at least one rod segment or rod segment group and a leading mechanical separator.

17. The apparatus of claim 1, wherein the at least one assembly revolves about an axis of rotation of its adjacent rotary portion and exerts said at least one process on the at least one rod segment or rod segment group when the processing compartment holding the at least one rod segment or rod segment group is proximate the supplementary processing zone.

18. The apparatus of claim 1, wherein the at least one assembly revolves about an axis of rotation of its adjacent rotary portion, and exerts the at least one process on the at least one rod segment or rod segment group through the at least one opening.

19. The apparatus of claim 18, wherein the opening is sized such that the at least one process is exerted on at least one selected rod segment of a rod segment group.

20. The apparatus of claim 18, wherein the at least one process results in a controlled radial or angular rotation of the at least one selected rod segment.

21. The apparatus of claim 1, wherein the at least one assembly does not exert any axial or normal forces on the transit path.

22. The apparatus of claim 1, wherein the inlet rotary portion has a planer axis aligned with centre of the rod segment cross-section.

23. The apparatus of claim 1, wherein the at least one supplementary processing zone has an adjustable length along the circumference of the adjacent rotary portion.

24. The apparatus of claim 1, wherein the at least one process is an overpressure in the at least one supplementary processing zone.

25. The apparatus of claim 1, wherein the at least one process is at least one of electromagnetic radiation, microwaves, laser, or ultrasonic waves penetration through the at least one rod segment or rod segment group when the processing compartment holding the at least one rod segment or rod segment group is proximate the supplementary processing zone.

26. The apparatus of claim 1, wherein a transit time for the at least one rod segment or rod segment group to travel the transit path is adjustable based on at least one of a size and an angular speed of at least one of the inlet rotary portion, the at least one intermediate rotary portion, and the discharge rotary portion to expose the at least one rod segment or rod segment group to the at least one supplementary processing zone for a predetermined period of time.

27. The apparatus of claim 26, wherein the at least one intermediate rotary portion is a variable capacity buffer including an active rotary portion and a passive rotary portion, a frame supporting the active rotary portion and the passive rotary portion, and an individually driven belt circumscribing the active rotary portion and a passive rotary portion.

28. The apparatus of claim 27, wherein the individually driven belt and the active rotary portion are perforated along their circumference in a contact area with the at least one rod segment or rod segment group to facilitate an application or intensity of the at least one process.

29. The apparatus of claim 27, wherein the variable capacity buffer permits the at least one rod segment or rod segment group to have a first inlet speed and a second discharge speed.

30. The apparatus of claim 27, wherein a position of the frame is movable between the inlet rotary portion and the discharge rotary portion to vary a distance between an axis of rotation of the active rotary portion and an axis of rotation of at least one of the inlet rotary portion and the discharge rotary portion.

31. The apparatus of claim 30, wherein a capacity of the variable capacity buffer increases when the distance between the axis of rotation of the active rotary portion and the axis of rotation of at least one of the inlet rotary portion and discharge rotary portion increases, and decreases when the distance between the axis of rotation of the active rotary portion and the axis of rotation of at least one of the inlet rotary portion and discharge rotary portion decreases.

32. The apparatus of claim 30, wherein a transit time for the at least one rod segment or rod segment group to travel the transit path increases when the distance between the axis of rotation of the active rotary portion and the axis of rotation of at least one of the inlet rotary portion and discharge rotary portion increases, and decreases when the distance between the axis of rotation of the active rotary portion and the axis of rotation of at least one of the inlet rotary portion and discharge rotary portion decreases.

33. The apparatus of claim 30, further comprising at least one set of belt tensioning rollers to ensure tension of the belt, and alignment of the variable capacity buffer with the inlet rotary portion and discharge rotary portion.

34. The apparatus of claim 27, wherein the frame is independently driven resulting in movement of the entire variable capacity buffer along a direction parallel with an axis of the frame.

35. The apparatus of claim 1, wherein at least one of the inlet rotary portion, the at least one intermediate rotary portion, and the discharge rotary portion does not have any mechanical separators.

36. The apparatus of claim 1, wherein a diameter of any of the inlet rotary portion, the at least one intermediate rotary portion, and the discharge rotary portion is adjustable, which further adjusts the length of the transit path.

37. The apparatus of claim 36, wherein a linear speed at a circumference of the inlet rotary portion is equal to a linear speed at a circumference of the at least one intermediate rotary portion and a linear speed at a circumference of the at least one discharge rotary portion.

38. The apparatus of claim 1, wherein at least one of the inlet rotary portion, the at least one intermediate rotary portion, and the discharge rotary portion has a planer axis perpendicular to the feeder belt.

39. The apparatus of claim 1, wherein an axis of rotation of the at least one intermediate rotary portion is perpendicular to an axis of rotation of the inlet rotary portion and the discharge rotary portion.

40. The apparatus of claim 1, wherein at least one of the inlet rotary portion, the at least one intermediate rotary portion, and the discharge rotary portion is a bevel wheel.

41. The apparatus of claim 40, wherein an axis of rotation of at least one of the inlet rotary portion, the at least one intermediate rotary portion, and the discharge rotary portion is not parallel to an axis of rotation of a preceding or a following rotary portion.

42. The apparatus of claim 41, wherein the axis of rotation of the at least one intermediate rotary portion is substantially vertical allowing its planar axis to remain horizontal during rotation.

43. The apparatus of claim 41, wherein the at least one intermediate rotary portion feeds additional articles into a stream of rod segments.

44. The apparatus of claim 43, wherein the at least one intermediate rotary portion feeds additional articles into an air gap between consecutive rod segments.

45. The apparatus of claim 43, further comprising a feeding means for feeding the additional articles to an upper part of the intermediate rotary portion for administering them at a required pace into the stream of rod segments.

46. The apparatus of claim 45, wherein the inlet rotary portion, the at least one intermediate rotary portion, and the discharge rotary portion are arranged to reverse an alignment of the stream of rod segments from a first alignment at the feeder belt to a second alignment at the discharge belt.

47. The apparatus of claim 40, wherein an angle of an axis of rotation of the at least one intermediate rotary portion is at an angle transverse to the feeder belt.

48. The apparatus of claim 47, wherein the angle of the axis of rotation of the intermediate rotary portions in the range from 0 to 60 deg.

49. The apparatus of claim 1, wherein a diameter of the at least one intermediate rotary portion is adjustable.

50. The apparatus of claim 49, wherein a position of the at least one intermediate rotary portion is adjustable relative to a position of the inlet rotary portion and the discharge rotary portion.

* * * * *